US006801164B2

(12) United States Patent
Bit-Babik et al.

(10) Patent No.: US 6,801,164 B2
(45) Date of Patent: Oct. 5, 2004

(54) BROAD BAND AND MULTI-BAND ANTENNAS

(75) Inventors: Giorgi Bit-Babik, Plantation, FL (US); Carlo Di Nallo, Sunrise, FL (US); Antonio Faraone, Plantation, FL (US); Quirino Balzano, Annapolis, MD (US); Revaz Zaridze, Tbilisi, GA (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/941,183

(22) Filed: Aug. 27, 2001

(65) Prior Publication Data

US 2003/0043075 A1 Mar. 6, 2003

(51) Int. Cl.[7] ..... H01Q 1/38

(52) U.S. Cl. ..... 343/700 MS; 343/785; 343/873

(58) Field of Search ..... 343/700 MS, 702, 343/785, 829, 846, 848, 873

(56) References Cited

U.S. PATENT DOCUMENTS

| | | | |
|---|---|---|---|
| 4,507,664 A | 3/1985 | James et al. | |
| 5,453,754 A | 9/1995 | Fray | |
| 5,696,517 A | 12/1997 | Kawahata et al. | |
| 5,760,746 A | 6/1998 | Kawahata | |
| 5,861,854 A | 1/1999 | Kawahata et al. | |
| 5,943,019 A | 8/1999 | Kawahata et al. | |
| 5,952,972 A | 9/1999 | Ittipiboon et al. | |
| 5,959,582 A | 9/1999 | Kawahata et al. | |
| 5,969,680 A | 10/1999 | Tsuru et al. | |
| 6,292,141 B1 * | 9/2001 | Lim | 343/700 MS |
| 6,323,808 B1 * | 11/2001 | Heinrichs et al. | 343/700 MS |
| 6,323,824 B1 * | 11/2001 | Heinrichs et al. | 343/846 |

OTHER PUBLICATIONS

Petosa, A. Ittipiboon, Y.M. M. Antar, D. Roscoe, "Recent Advances in Dielectric–Resonator Antenna Technology," IEEE Antennas and Propogation Magazine, vol. 40, No. 3, Jun. 1998.

Petosa, A., Simons, N., Suiushansian, R. Ittipiboon, A. Cuhaci, M. "Design and Analysis of Multisegment Dielectric Resonator Antennas," IEEE Antennas and Transactions on Antennas and Propogation Magazine, vol. 48, No. 5, May 2000.

* cited by examiner

*Primary Examiner*—James Vannucci
*Assistant Examiner*—Shih-Chao Chen

(57) ABSTRACT

Antenna systems (200, 1300, 1500, 1900, 2000, 2400) comprise a dielectric resonator antenna (210) in the shape of a parallelepiped with right angle corners. The thickness (T) of the dielectric resonator antenna (210) is chosen to be less than the length and height. The antenna systems (200, 1300, 1500, 1900, 2000, 2400) provide have broad band response that is attributed to two or more resonant modes that have center frequencies that are closely spaced in frequency relative to their bandwidths. Additional pass bands can be obtained by placing a conductive strip (1302) along an edge of the dielectric resonator 210. The passband associated with the conductive strip (1302) can be lowered in frequency by capacitively loading the conductive strip (1302). An additional passband can also be obtained by coupling a metal ribbon (2012) to a feed in microstrip (206, 2002) and to the dielectric resonator antenna (210).

36 Claims, 15 Drawing Sheets

1200

BROAD BAND AND MULTI-BAND ANTENNAS

FIELD OF THE INVENTION

This invention pertains to antennas. More particularly this invention pertains to broad band and multi-band antennas.

BACKGROUND OF THE INVENTION

Currently in the wireless communication industry there are a number of competing communication protocols that utilize different frequency bands. In a particular geographical region there may be more than one communication protocol in use for a given type of communication e.g., wireless telephones. Also certain communication protocols may be exclusive to certain regions. Additionally future communication protocols are expected to utilize different frequency bands. It may be desirable to provide 'future proof' communication devices that are capable of utilizing a currently used communication protocol, as well as communication protocols that are expected to be utilized in the near future.

It is desirable to be able to produce wireless communication devices capable of operating according to more than one communication protocol. The latter may necessitate receiving signals in different frequency bands. It would be desirable to have smaller antennas for wireless communication devices that are capable of operating at multiple frequencies, rather than having separate antennas for different frequencies.

Some known antennas exhibit peaks in radiative efficiency at frequencies that are harmonics of a base operating frequency. Unfortunately these resonances are likely to be spaced too far apart in frequency, and in any case not at the correct frequencies for communication protocols that are to be supported.

What is needed is an antenna that is capable of operating over a wide frequency range.

Wireless communication devices have shrunk to the point that monopole antennas sized to operate at the operating frequency of the communication device are significant in determining the overall size of the communication devices in which they are used. In the interest of user convenience in carrying portable wireless communication devices, it is desirable to reduce the size of the antenna.

One approach to reducing the overall size of the radiating system of a handheld device is to use a ground plane within the housing of the handheld device, along with a counterpoise that is loaded by a high dielectric constant material, and extends out of the housing as an antenna system. Unfortunately, the hand of a user holding such a handheld device will intercept field lines crossing from the ground plane to the counterpoise and partially block signals passing to and from the antenna system.

What is needed is a small antenna for use in portable wireless communication devices that does not require a large counterpoise.

Commonly wireless phones are equipped with antennas (e.g., wire monopole wire antennas) the radiation patterns of which are independent of azimuth angle. It is desirable to have an antenna that radiates more efficiently within one hemisphere of solid angle about the antenna, in order to achieve higher antenna gain.

What is needed is a more directional antenna that achieves higher antenna gains.

It would be desirable to have a small size antenna that is capable of operating in two or more bands that are widely separated in frequency.

BRIEF DESCRIPTION OF THE FIGURES

The features of the invention believed to be novel are set forth in the claims. The invention itself, however, may be best understood by reference to the following detailed description of certain exemplary embodiments of the invention, taken in conjunction with the accompanying drawings in which:

DETAILED DESCRIPTION OF THE PREFERRED EMBODIMENT

Figure 1:
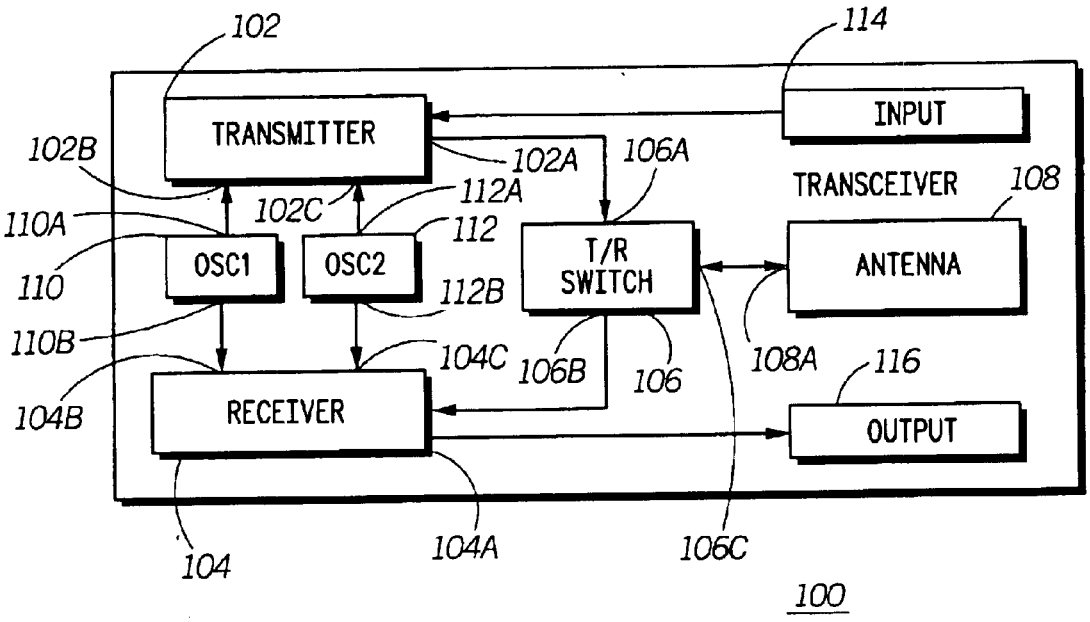
FIG. 1 is a block diagram of a transceiver.

While this invention is susceptible of embodiment in many different forms, there are shown in the drawings and will herein be described in detail specific embodiments, with the understanding that the present disclosure is to be considered as an example of the principles of the invention and not intended to limit the invention to the specific embodiments shown and described. Further, the terms and words used herein are not to be considered limiting, but rather merely descriptive. In the description below, like reference numbers are used to describe the same, similar, or corresponding parts in the several views of the drawings.

FIG. 1 is a block diagram of a transceiver 100. The transceiver 100 has the following design. A first oscillator 110 has a first oscillator output 110A coupled to a first transmitter oscillator input 102B of a transmitter 102 and a second first oscillator output 110B coupled to a first receiver oscillator input 104B of a receiver 104. The transmitter 102 and the receiver 104 are communication circuits. Similarly a second oscillator 112 has a first second oscillator output 112A coupled to a second transmitter oscillator input 102C of the transmitter 102, and a second second oscillator output 112B coupled to a second receiver oscillator input 104C of the receiver 104. An input 114 is coupled to the transmitter 102. An output 116 is coupled to the receiver. According to an embodiment of the invention the input comprises a voice input, e.g., a microphone 2704 (FIG. 28) and a digital voice encoder and the output 116 comprises a voice data decoder and a speaker 2706 (FIG. 28). The transmitter 102 serves to modulate either a first high frequency signal received from the first oscillator 110 or a second high frequency signal received from the second oscillator 112 with a data signal received from the input 114. The first and second high frequencies signals are characterized by two different frequencies. According to an alternative embodiment of the invention two or more different carrier frequencies are generated by a single tunable oscillator. The two frequencies can be selected to conform to two different communication standards supported by the transceiver 100. For example the GSM Europe communication protocol calls for carrier frequencies of 900 MHz and 1.8 GHz whereas the proposed UMTS communication protocol calls for a carrier frequency in the range of 2.0 to 2.1 GHz Hz.

The transmitter 102 further comprises a signal output 102A that is coupled to a signal input 106A of a transmit/receive (T/R) switch 106. The T/R switch 106 further comprises a signal output 106B that is coupled to a signal input 104A of the receiver 104. The T/R switch 106 further comprises an antenna port 106C coupled an antenna system input 108A of an antenna system 108.

In order to support multiple communication standards that require different carrier frequencies the antenna 108 should have a frequency response that includes either a broad band that encompasses multiple frequencies and/or multiple bands corresponding to multiple carrier frequencies. The antennas taught by the present invention have broad bands and multiple bands and are useful for communication devices (e.g. transceiver 100) that support multiple communication protocols that require different operating frequencies.

Figure 2:
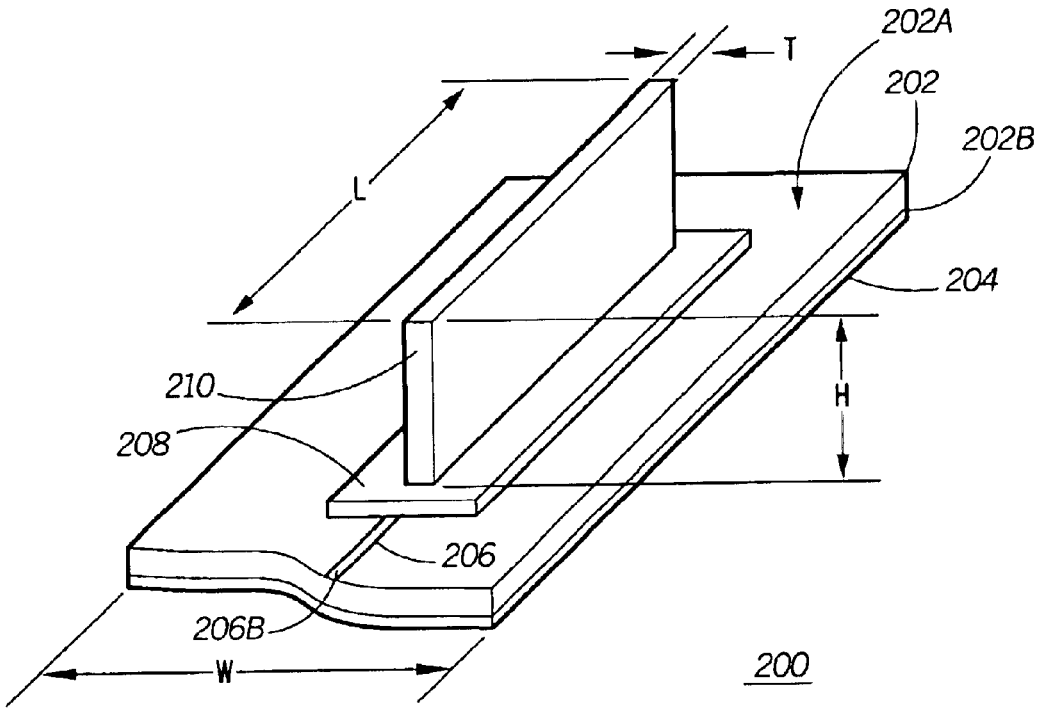
FIG. 2 is a broken out perspective view of a circuit board supporting a dielectric resonator antenna according to a preferred embodiment of the invention.

FIG. 2 is a broken out perspective view of an antenna system 200 in the form of a circuit board 202 supporting a dielectric resonator antenna 210 according to a preferred embodiment of the invention. Referring to FIG. 2 the circuit board comprises a substrate 202, a ground plane 204 borne on a lower surface 202B of the substrate 202, and a transmission line in the form of a microstrip 206 borne on an upper surface 202A of the substrate 202. A proximal end 206B of the microstrip 206 serves as the antenna system input 108A (FIG. 1). The microstrip 206 serves as a signal feed for coupling signals to and from the dielectric resonator antenna 210. Although a microstrip 206 is preferred, alternatively other types of transmission lines such as coaxial cable, slot lines, or waveguides are used. A relatively low dielectric constant spacer layer 208 is located above the microstrip 206. The dielectric resonator antenna 210 is located on the low dielectric constant spacer layer 208 above the microstrip 206. The dielectric constant of the dielectric resonator antenna 210 is preferably at least about 25, more preferably at least about 40. According to an exemplary embodiment of the invention the dielectric resonator antenna 210 is made out of Neodymium Titanate which has a dielectric constant of 80. Magnesium Calcium Titanate which has a dielectric constant of 140 is also suitable as are other existing high permittivity and low loss materials. Making the dielectric resonator antenna 210 out of a high dielectric constant material and dimensioning the dielectric resonator antenna 210 as taught herein allows a dielectric resonator antenna 210 that is small in size, has substantially reduced emission in one hemisphere, and has a broad band and/or multi-band response to be obtained. The length (L), height (H), and thickness (T) of the dielectric resonator antenna are indicated on FIG. 2. Using a higher dielectric constant material, results in a reduction in the size of dielectric resonator antennas. Ordinarily the penalty paid is a reduction in bandwidth. However the present invention provides a small antenna that exhibits a large bandwidth.

The low dielectric constant spacer layer 208 preferably has a dielectric constant that is preferably much less that the dielectric constant of the dielectric resonator antenna 210. The dielectric constant of the low dielectric constant spacer layer 208 is preferably no more than about 4. The inventors have found that interposing the low dielectric constant spacer layer 206 between the microstrip 206 and the dielectric resonator antenna 210 enhances the A electromagnetic coupling of signals between the dielectric resonator antenna 210 and the microstrip 206. The dielectric spacer layer 208 preferably has a thickness (i.e. the dimension measured perpendicular to the surface 202A of the substrate 202 between microstrip 206, and the dielectric resonator antenna 210) of between 50 and 500 microns. The dielectric spacer layer 208 preferably comprises a material selected from the group consisting of polytetrafluoroethylene, paper, or air.

The ground plane 204 serves as a conductive shield that reduces the power radiated within one hemisphere, namely the hemisphere that has the ground plane 204 as its base and faces the direction opposite to the dielectric resonator antenna 210. In order to substantially reduce the radiation in one hemisphere, the ground plane 204 should have a lateral width that is equal to at least about 0.95 times the height of the dielectric resonator antenna 210. The shield width is indicated by W in FIG. 2, and measured parallel to the thickness T of the dielectric resonator antenna 210. The width W of the ground plane 204 is preferably less than about 3.5 times the height of the antenna 210. Little additional practical benefit is accrued in terms of the directivity of the radiation pattern if the width of the ground plane 204 is increased beyond 3.5 times the height of the dielectric resonator antenna 210. Additionally keeping the width of the ground plane 204 below about 3.5 times the height of the dielectric resonator antenna 210 allows for a compact antenna system 200. Because the dielectric resonator antenna 210 design according to the teachings of the present invention is relatively small, the ground plane 204 can be made small while still increasing the power radiated, and directional gain in at least one hemisphere.

Figure 3:
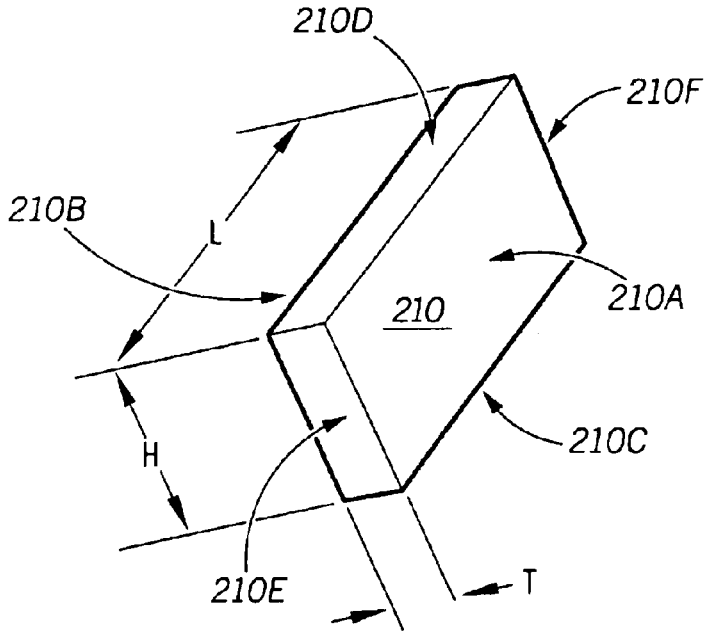
FIG. 3 is a perspective view of the dielectric resonator antenna shown in FIG. 2.

FIG. 3 is a perspective view of the dielectric resonator antenna 210 shown in FIG. 2. Dielectric resonator antenna 210 has a prism shape, more specifically a parallelepiped shape, and even more specifically a parallelepiped with 90 degree angles between all pairs of adjacent sides. We term the latter shape a 'right parallelepiped'. The dielectric resonator antenna 210 has a first large area surface 210A and a second large area surface 210B opposite to the first large area surface 210A. The first and second large area surfaces 210A, 210B have dimensions of L by H. The dielectric resonator antenna 210 further comprises a lower edge 210C extending between the first large area surface 210A and the second large area surface 210B, and an upper edge 210D opposite to the lower edge 210C. The lower edge 210 C is located proximate to the microstrip 206 (FIG. 2). The upper 210D and lower 210C edges have dimensions L by T. The dielectric resonator antenna 210 further comprises a first end edge 210E, and a second end edge 210F opposite to the first end edge. The first 210E and second 210F end edges extend between the first 210A and second 210B large area surfaces, and between the upper 210D and lower 210C edges. The first 210E and second 210F end edges have dimensions T by H.

According to the preferred embodiment of the invention the thickness T of the dielectric resonator antenna 210 is much less than either the height H or the length L. Preferably, the thickness T of the dielectric resonator antenna 210 is less than a 1/10 of its length L. Expressed in terms of the operating wavelength, the thickness T is preferably no more than 1/40 times the wavelength associated with the lowest carrier frequency with which the antenna is used. By choosing a low thickness T compared to the length L and height H, a lower ratio of volume to surface of the dielectric resonator antenna 210 is obtained. Preferably the quantity:

$$A*\lambda/V,$$

where A is the surface area of the dielectric resonator antenna 210;

λ is the free space wavelength corresponding to the frequency of the lowest order longitudinal mode of the dielectric resonator antenna (See FIG. 5); and V is the volume of the dielectric resonator antenna, is at least about 50. More preferably the quantity A*λ/V is at least about 100.

While not wishing to be bound by any particular theory it is believed that choosing a relatively low thickness has two effects that together allow very broad band frequency response to be achieved. The first effect is the reduction of the quality factor (Q) associated with resonances of the dielectric resonator antenna 210. Reduction in Q is associated with an increased bandwidth of individual resonances. The reduced Q may result from the high ratio of surface area to volume, however the invention should not be construed as limited to any particular theory of operation.

The second effect of choosing a relatively low thickness is to lower the frequency separation between modes that correspond to successive values of the mode index corresponding to the length dimension of the dielectric resonator antenna 210. This can be understood by making an analogy to a conducting rectangular box cavity. The frequencies associated with resonant modes of a rectangular conductive box cavity are given by:

$$f = \frac{c}{2\pi}\sqrt{\left(\frac{m\pi}{L}\right)^2 + \left(\frac{n\pi}{H}\right)^2 + \left(\frac{l\pi}{T}\right)^2}$$

where f is a center frequency of a resonance;

c is the speed of light;

L is the length of the box cavity;

H is the height of the box cavity;

T is the thickness of the box cavity;

m is a mode index associated with the length dimension of the cavity;

n is a mode index associated with the height dimension of the cavity;

l is a mode index associated with the thickness dimension of the cavity.

If the thickness T dimension is much smaller than either the height H dimension or the length L dimension, then changing the value of the mode index associated with either the height H or the length L will have a relatively small effect on the resonant frequency f (compared to changing the index associated with the thickness dimension). This analogy is somewhat limited in that unlike the dielectric resonator antenna 210, the electric fields in a rectangular box cavity drop zero at the walls and absent any apertures a rectangular box cavity does not radiate. The operation of the dielectric resonator 210 on the other hand is dependent on the electric field not dropping to zero at its boundaries. In hindsight the analogy is useful for qualitatively understanding how choosing a relatively low thickness T leads to resonances with closely spaced center frequencies.

By choosing a relatively low value of thickness T a dielectric resonator antenna 210 is obtained that exhibits two or more broad band resonances that have center frequencies that are so close that the difference between the center frequencies associated with adjacent resonances is comparable to their bandwidths. Preferably the thickness T is chosen sufficiently small so that the difference between the center frequencies of two adjacent resonance bands is equal to from one-half to two times the bandwidth of at least one of the bands. The bandwidths of the two resonance bands usually comparable, e.g., within a factor of two of each other.

The dimensions of the dielectric resonator antenna 210 are preferably chosen so that two modes that differ by about unity in the value of the mode index associated with the length dimension correspond to an upper center frequency and a lower center frequency, and the difference between the two center frequencies divided by the lower center frequency is between 0.05 and 0.25. (For the dielectric resonator the mode indexes may not, strictly speaking, have integer values.)

By placing the microstrip 206 adjacent to and aligned with the lower edge 210C (and length dimension) of the dielectric resonator antenna 210 it is possible to couple to two or more modes corresponding to different values of the mode index associated with the length dimension L of the dielectric resonator antenna 210. Choosing the length L to thickness T ratio according to the aforementioned preference, leads to the two or more modes having closely spaced center frequencies and bands that are broad enough to substantially overlap. This creates a large bandwidth composite pass band from bands associated with the two modes, and results in an antenna system 200 that exhibits desirable broad band operation.

The length L of the dielectric resonator antenna 210 is preferably less than about ¼ of the free space wavelength corresponding to the lowest frequency mode (See FIG. 5) of the dielectric resonator antenna 210. By setting the length at such a small value, a dielectric resonator antenna 210 that is markedly smaller than conventional conductive antennas is obtained. Such a small dielectric resonator antenna 210 is particularly suitable for use in compact portable wireless devices. In order to achieve such a dielectric resonator antenna 210 with the aforementioned preferred choice of length (L) the height (H) is preferably chosen to be between about ¼ and one times the length (L).

Figure 4:
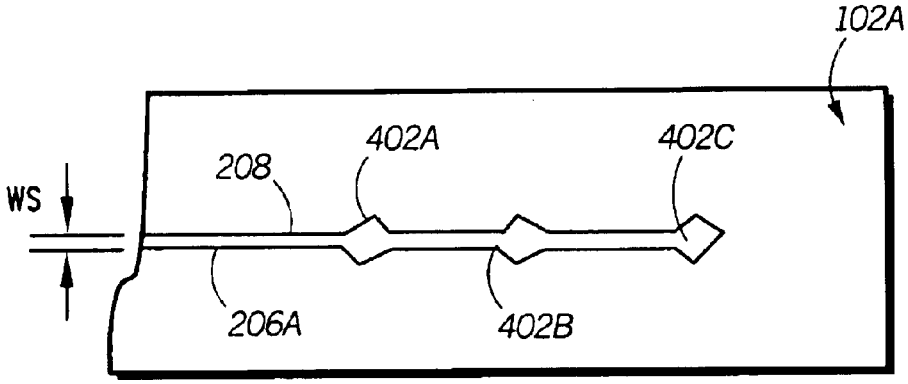
FIG. 4 is a plan view of the circuit board shown in FIG. 2 without the dielectric resonator antenna.

FIG. 4 is a plan view of the circuit board shown in FIG. 2 without the dielectric resonator antenna 210 (FIG. 2). FIG. 4 shows the microstrip 206 (FIG. 2) located on the top surface 202A of the substrate 202 (FIG. 2). The inventors have found that in general in order to obtain good coupling between microstrip 206 and the dielectric resonator antenna 210 described above, the width of the microstrip indicated as WS in FIG. 4 should be at least about half of the thickness of the dielectric resonator antenna 210. FIG. 4 illustrates a preferred form of the microstrip 206 that includes first second and third charge accumulation regions 402A, 402B, and 402C spaced along its length. The charge accumulation regions 402A, 402B, and 402C capacitively load the microstrip 206. The first charge accumulation 402A is located nearest the proximal end 206B of the microstrip 206. The second charge accumulation region 402B is spaced further from the proximal end, and the third charge accumulation region is located furthest. The charge accumulation regions 402A, 402B, and 402C preferably take the form of portions of the microstrip 206 characterized by increased lateral width relative to intervening portions of the microstrip 206. During operation the charge accumulation regions 402A, 402B, and 402C correspond to points of high electric field magnitude at the lower edge 210C (FIG. 3) of the dielectric resonator antenna 210. The charge accumulation regions 402A, 402B, and 402C have been found to enhance the electromagnetic coupling between the microstrip 206 and the dielectric resonator antenna 210. Although, only three charge accumulation regions 402A, 402B, and 402C are provided and preferred, more could be provided for the purpose of coupling to higher order modes characterized by higher values of the mode index associated with the length dimension L of the dielectric resonator antenna 210.

Figure 5:
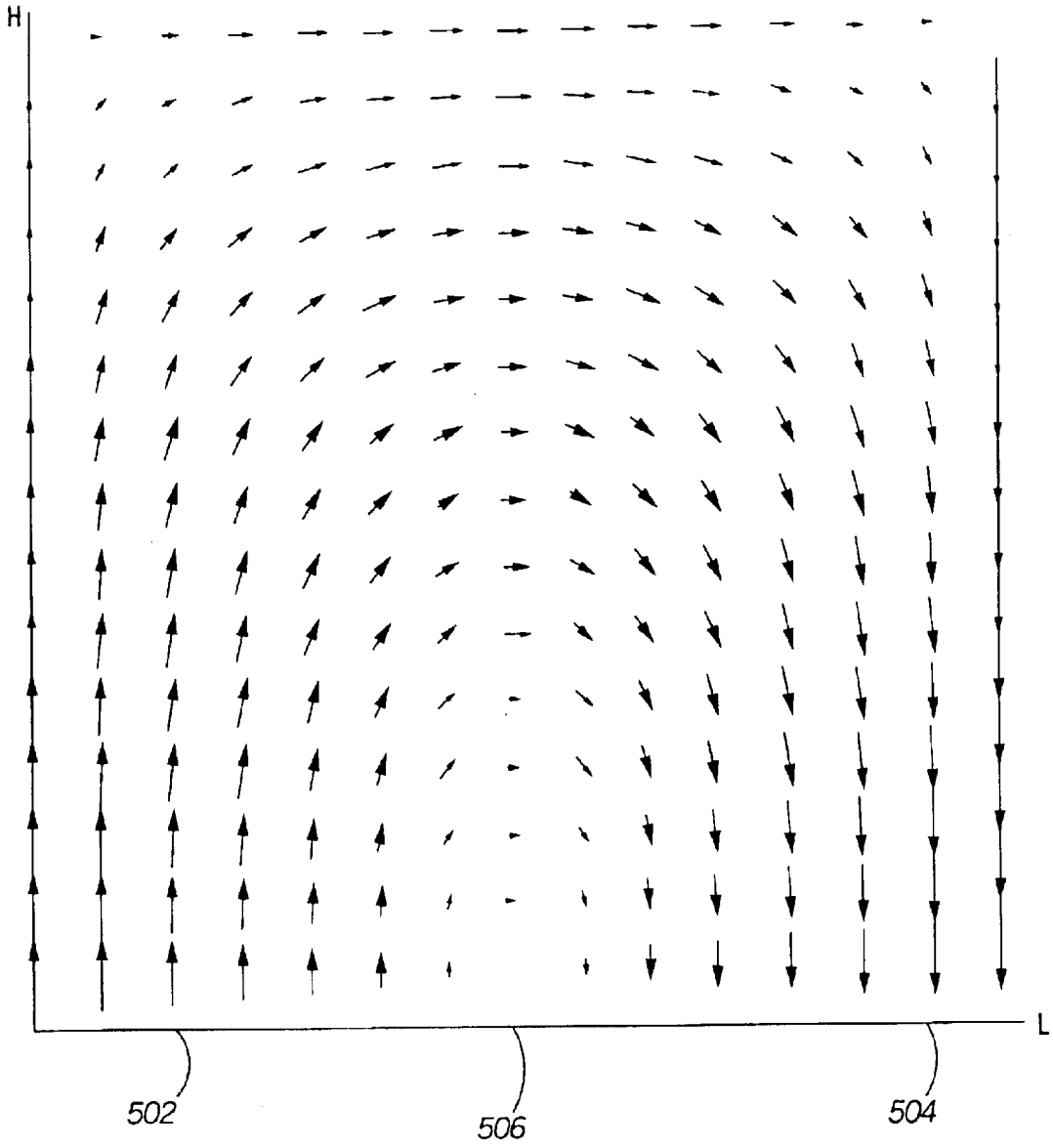
FIG. 5 is an elevation view of the electric field pattern of a first mode of the dielectric resonator antenna shown in FIG. 2 and FIG. 3.

FIG. 5 is an elevation view of the electric field pattern of a first mode of the dielectric resonator antenna 210 shown in FIG. 2 and FIG. 3. The first mode is the lowest order mode of the dielectric resonator antenna 210. The first mode is designated $TE_{11\delta}$. The first index in the $TE_{11\delta}$ mode designation, the value of which is one, corresponds to the height (H) dimension of the dielectric resonator antenna 210, the second index the value of which is also one for the $TE_{11\delta}$ mode corresponds to the length (L) dimension of the dielectric resonator antenna 210, and the third index δ the value of which is less than one for the $TE_{11\delta}$ mode corresponds to the thickness dimension. The first and second indexes are approximate. The abscissa of FIG. 5 corresponds to the length dimension L and the lower edge 210C of the dielectric resonator antenna 210. The ordinate of FIG. 5 corresponds to the height dimension H of the dielectric resonator antenna 210. Only half of the mode pattern is present. The microstrip ground 204 (FIG. 2) serves as a virtual symmetry plane that terminates the field lines at the abscissa. In the first mode, there is a first region 502 proximate the first end edge 210E (FIG. 3), and the lower edge 210C (FIG. 3) of the dielectric resonator 210 at which the electric field is strong and oriented approximately normal to the surface 206A of the microstrip 206. The same field characteristics obtain at a second region 504 proximate the lower edge 210C and the second end edge 210F (FIG. 3) of the dielectric resonator antenna 210. The field vectors at the first region 502 are antiparallel to the field vector at the second region 504. At the center of the lower edge 210C there is a field null 506. Within the dielectric resonator antenna 210 the field curves around between the first 502 and second region 504. When the dielectric resonator antenna 210 operating in the mode illustrated in FIG. 5 is used in combination with the microstrip 206 illustrated in FIG. 4 the first 402A and third 402C charge accumulations regions will correspond in position to the first 502 and second 504 regions of high field concentration respectively. The presence of the first 402A and third 402C charge accumulations regions will enhance the electromagnetic coupling between the microstrip 206 and the dielectric resonator antenna 210. The second charge accumulation region 402B that is located between the first 402A and third 402C charge accumulation regions will have a negligible effect on the coupling to the mode illustrated in FIG. 5.

Figure 6:
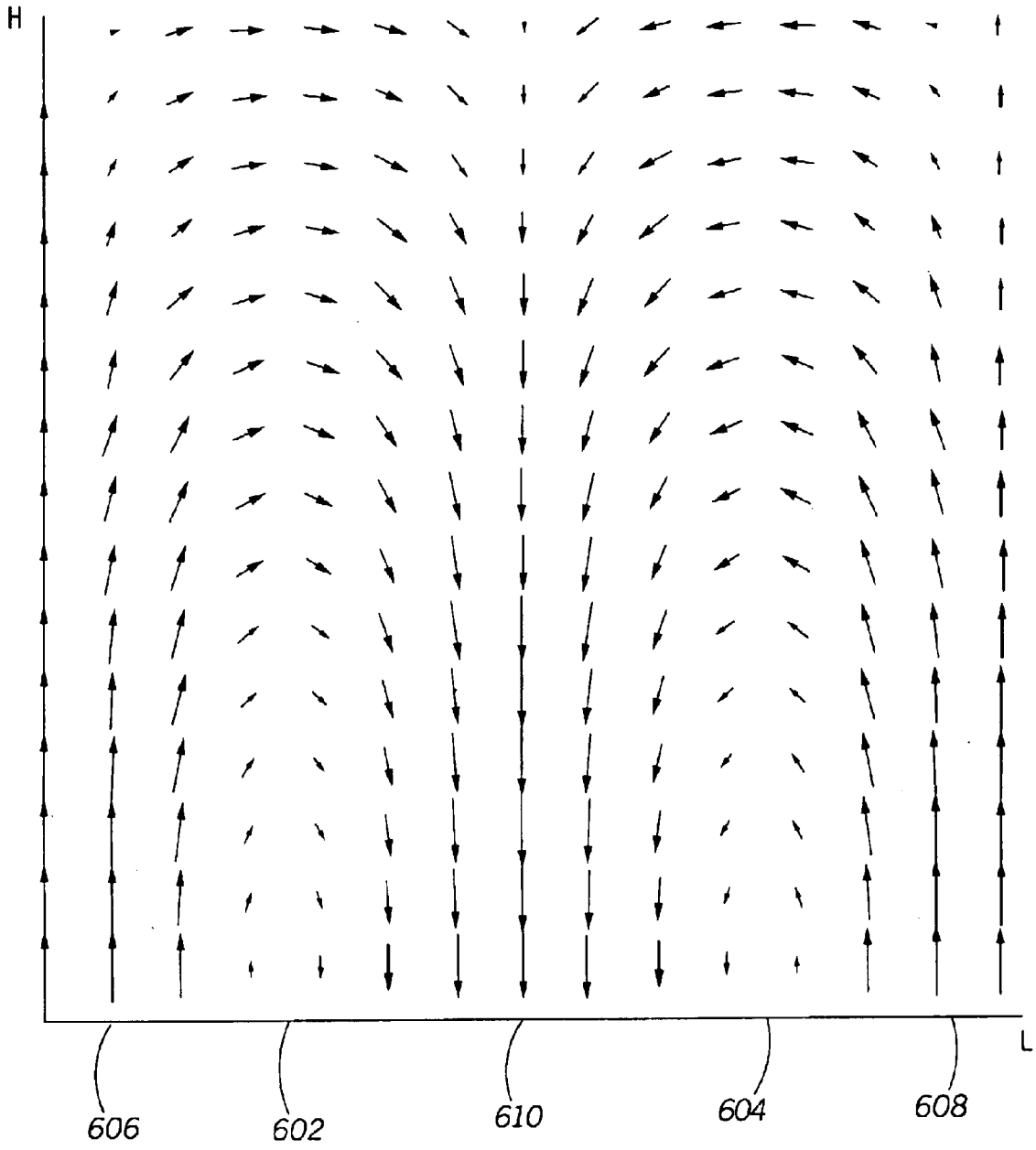
FIG. 6 is an elevation view of the electric field pattern of a second mode of the dielectric resonator antenna shown in FIG. 2 and FIG. 3.

FIG. 6 is an elevation view of the electric field pattern of a second mode of the dielectric resonator antenna 210 shown in FIG. 2 and FIG. 3. The second mode is designated $TE_{12\delta}$. The second index for the $TE_{12\delta}$ mode that has a value of two indicates that there are two field nulls 602, 604 along the lower edge 210C (FIG. 3) of the dielectric resonator antenna 210. The abscissa and ordinate of FIG. 6 have the same relation to the dielectric resonator antenna 210 as those of FIG. 5. The second mode has first and second regions 606, 608 located adjacent the lower edge 210C and near the first 210E (FIG. 3) and second 210F (FIG. 3) end edges respectively at which the electric field has a high magnitude and is oriented perpendicular to the microstrip 206. The field vectors in the first and second regions are parallel. There is a third region 610 located near the lower edge 210C of the dielectric resonator antenna 210, midway between the first end edge 210E and the second end edge 210F at which the field also has a high magnitude and is oriented perpendicular to the microstrip. The field vectors at the third region are antiparallel to the field vectors at the first and second regions. The first field null 602 is located at the lower edge 210C between the first 606 and third regions 610 of high field magnitude. The second field null 604 is located at the lower edge 210C between the second 608 and third 610 regions of high field magnitude. Within the dielectric resonator antenna 210 the electric field curves around from the first region of high field magnitude 606 to the third region of high field magnitude 610. Also within the dielectric resonator antenna 210, the electric field curves around from the second region of high field magnitude 608 to the third region of high field magnitude 610. Although the field pattern of the mode shown in FIG. 5 is markedly different from the field pattern of the mode shown in FIG. 6 the frequencies are relatively close due to the relatively weak dependence of the dielectric resonator antenna's 210 resonant frequency on the mode index associated with the length dimension compared to its dependence on the mode index associated with the thickness dimension.

The frequency responses associated with the modes shown in FIG. 5 and FIG. 6 combine to yield a broad band that is useful for supporting multiple communication standards at multiple frequencies (e.g. two frequencies corresponding respectively to the first 110 (FIG. 1) and second 112 (FIG. 1) oscillators.)

When the dielectric resonator 210 operating in the mode illustrated in FIG. 6 is used in combination with the microstrip illustrated in FIG. 4 each of the three charge accumulation regions 402A, 402B, and 402C will be located proximate to one of the aforementioned high field magnitude regions 606, 610, 608. The charge accumulation regions 402A, 402B and 402C serve to enhance the electromagnetic coupling between transmission line 206 and the dielectric resonator antenna 210.

Thus by provided three charge accumulation regions 402A, 402B, and 402C spaced along the microstrip 206, the coupling between the microstrip 206 and two modes of the dielectric resonator antenna 210 (illustrated in FIG. 5 and FIG. 6) that have different values of the mode index associated with the length L dimension of the dielectric resonator antenna 210 is enhanced.

Figure 7:
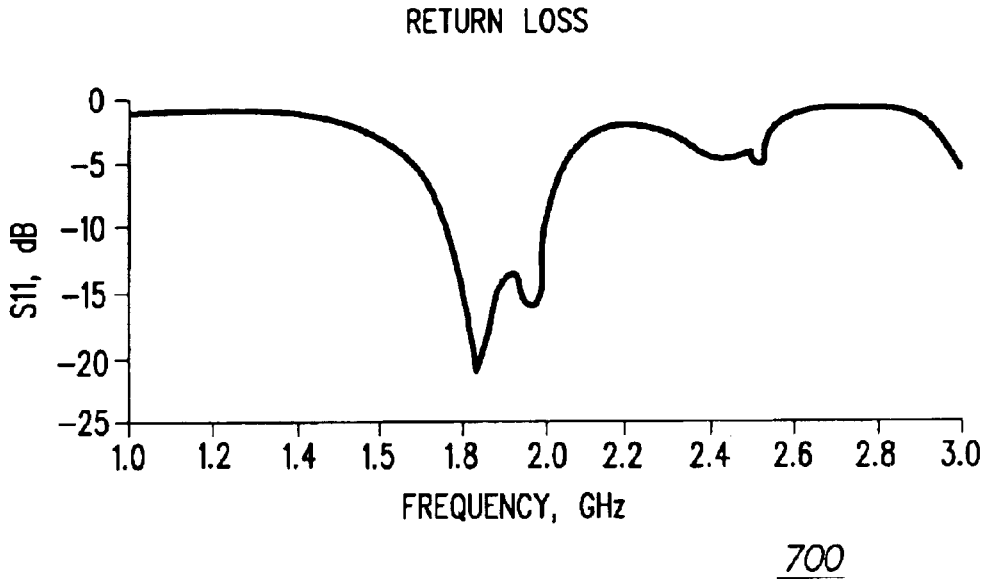
FIG. 7 is a graph of return loss versus frequency for a dielectric resonator antenna of the type shown in FIG. 2 and FIG. 3.

FIG. 7 is a graph of return loss versus frequency for a dielectric resonator antenna 210 of the type shown in FIG. 2. The antenna 210 from which the measurements shown in FIG. 7 were taken had a length of 40 mm, a height of 15 mm, a thickness of 2 mm and a dielectric constant of 80. The low dielectric constant spacer 208 was made out of paper which had a dielectric constant of about 1 and a thickness of 0.1 mm. The microstrip 206 had a width of 1.6 mm. The microstrip 206 exhibited an impedance of 50 Ohms. The charge accumulation regions 402A, 402B, and 402C were diamond shaped as shown in FIG. 4 with an edge length of about 3 mm. The distance between the charge accumulation regions 402A, 402B, and 402C was about 12 mm.

As seen in the FIG. 7 graph, the measured antenna 210 exhibited a first resonance characterized by a center frequency of about 1.84 GHz, and a second resonance characterized by a center frequency of about 1.98 GHz. Although the invention should not be construed as limited by any theory of operation set forth herein, it is believed, that the first resonance corresponds to the oscillation mode depicted in FIG. 5 and the second resonance corresponds to the oscillation mode depicted in FIG. 6. The bandwidth of the individual modes is at least comparable in magnitude to the separation between the center frequencies. If the bandwidth of each mode were much less than the separation between the center frequencies, then the graph would manifest two distinct resonances. As seen in FIG. 7 the radiation associated with the two resonances results in a frequency response that includes a broadband of high radiative efficiency that includes the center frequencies of the two modes. It is believed that for frequencies within this band, electromagnetic energy is coupled into both modes simultaneously. Preferably the bandwidth of at least one of the resonances is equal to from one-half to two times the separation between the center frequencies. If the bandwidth of both resonances is at least about one-half the separation between the center frequencies of the resonances then a large band that includes the center frequencies (as shown in FIG. 7) will be obtained. If the bandwidth of one of the resonances is substantially greater than two times the separation between the center frequencies, then the effect of utilizing two modes on the overall bandwidth will be diminished. The pass band of the dielectric resonator antenna 210 the frequency response of which is shown in FIG. 7 is, measured from the −10 dB points of the graph, 0.25 GHz. The fractional bandwidth is about 12%. It is practical to use the antenna at wavelengths for which the return loss is less than −10 dB. The bandwidth associated with the two modes depicted in FIGS. 5 and 6 can be reckoned by examining the outer curve portions (flanks) of the passband in each return loss plot. For the first mode which has a center frequency of about 1.84 GHz in the return loss plot 700 shown in FIG. 7, the curve portion to the left of 1.84 can be examined to determine the bandwidth associated with the first mode FIG. 5. The frequency at the −10 bB point (1.76 GHz) can be taken as the left hand band limit, and the bandwidth calculated by multiplying the difference between the center frequency (1.84 GHz) and the −10 bB point (1.76 GHz) by two. The calculated result is about 140 MHz. This is about equal to difference (140 MHz) between the center frequencies of the center frequencies of about 1.84 GHz and about 1.98 GHz associated with the two modes.

Figure 8:
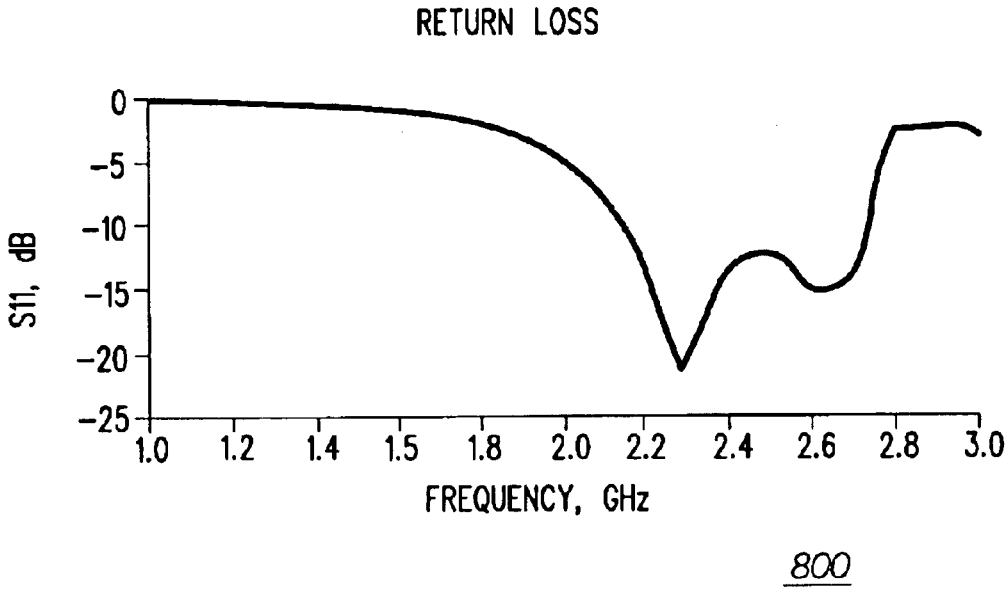
FIG. 8 is a graph of return loss versus frequency for another dielectric resonator antenna of the type shown in FIG. 2 and FIG. 3.

FIG. 8 is a graph 800 of return loss versus frequency for another dielectric resonator antenna 210 of the type shown in FIG. 2 and FIG. 3. The dielectric resonator antenna 210 which was used to obtain the measurement data shown in FIG. 10 had a length of 25 mm, a height of 23 mm, and a thickness of 2 mm. The ground plane 204 had a width of 22 mm and a length of 45 mm. The microstrip 206 (FIG. 2) used with this dielectric resonator antenna 210 did not include charge accumulation regions 402A, 402B and 402C. No spacer layer 208 was used in the antenna system used to obtain the return loss plot shown in FIG. 8. The return loss includes a first resonance characterized by a center frequency of about 2.3 GHz, and a second resonance characterized by a center frequency of about 2.65 GHz. This dielectric resonator antenna 210 has a fractional bandwidth of 23%. The large fractional bandwidth allows this dielectric resonator antenna to support communication at a number of frequencies within the broad pass band.

Figure 9:
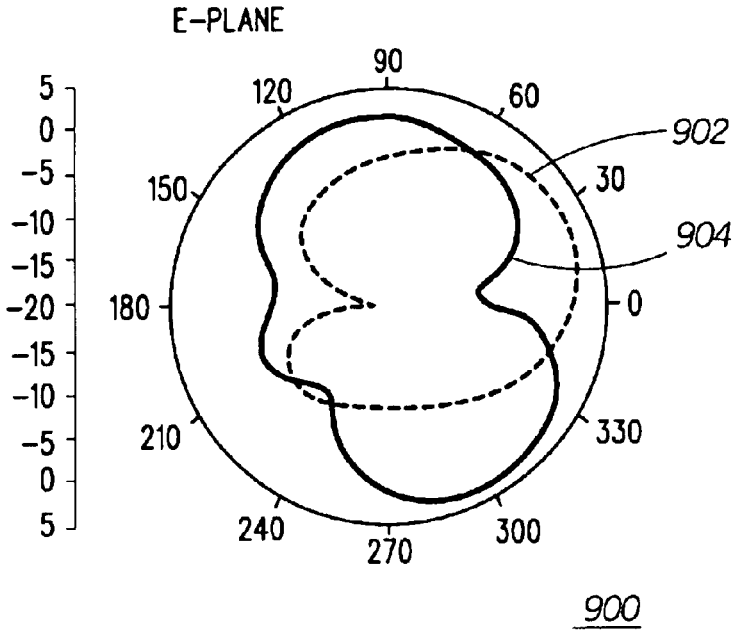
FIG. 9 is a set of E-plane gain plots for an embodiment of the dielectric resonator antenna shown in FIG. 2 and characterized by the frequency response shown in FIG. 8.
Figure 10:
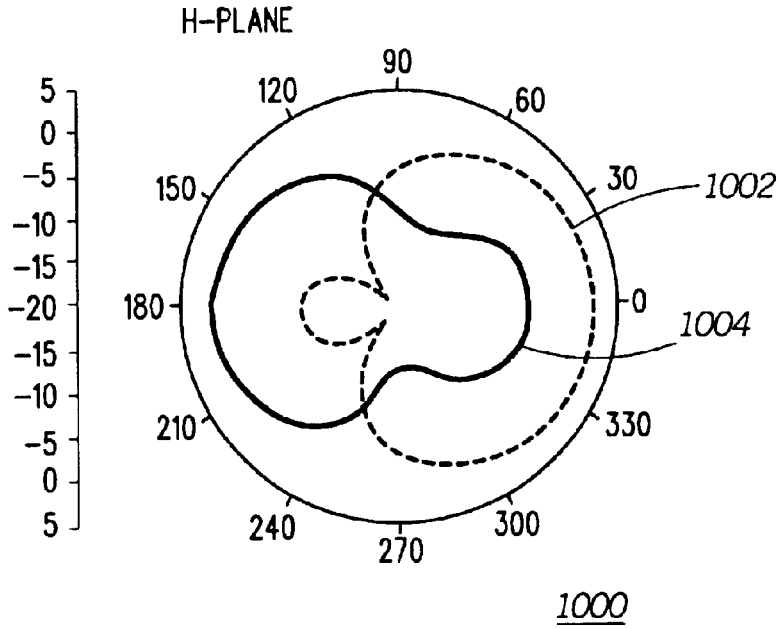
FIG. 10 is set of H-plane gain plots corresponding to FIG. 9.

FIG. 9 is a set of E-plane gain plots 900 for an embodiment of the dielectric resonator antenna shown in FIG. 2 and characterized by the frequency response shown in FIG. 8. The E-plane includes the length (L) and height (H) dimensions of the dielectric resonator antenna 210. FIG. 10 is set of H-plane gain plots 1000 corresponding to FIG. 9. The H-plane includes the height (H) and thickness (T) dimensions of the dielectric resonator antenna. The radial axes of FIGS. 9 and 10 are marked off in decibels, as indicated.

In FIG. 9 and other gain plots discussed hereinafter, zero is on the side of the upper edge 210D and 180 is on the side of the lower edge 210C of the dielectric resonator antenna 210.

The set of plots 900 includes a first E-plane plot 902 measured at 2.28 GHz. Referring to FIG. 8 it is seen that 2.28 GHz corresponds to a center frequency of a resonance in the frequency response of the dielectric resonator antenna 210 with which the data shown in FIG. 8 was taken. The first plot includes a main lobe centered at about 15 degrees in the E-plane. The corresponding H-plane plot 1002 includes a main lobe centered at zero degrees. The radiation pattern at 2.28 GHz is akin to a dipole radiation pattern and is consistent with the mode of the dielectric resonator antenna 210 shown in FIG. 5.

The set of plots 900 includes a second E-plane plot 904 measured at 2.7 GHz. Referring to FIG. 8 it is seen that 2.7

GHz corresponds to a center frequency of another resonance in the frequency response of the dielectric resonator antenna 210 with which the data shown in FIG. 8 was taken. A corresponding H-plane plot 1004 is shown in FIG. 10. The second E-plane plot 904 includes two main lobes located on opposite sides of zero. The radiation pattern at 2.7 GHz is akin to a quadrupole radiation pattern, and is consistent with the mode of the dielectric resonator antenna shown in FIG. 6.

The two different patterns correspond to the two different modes in resonator. The first pattern for the first mode has one lobe and the second has two lobes. This is in agreement with the field structure of these two modes inside the resonator shown on FIG. 5 and FIG. 6.

The solid angle around the dielectric resonator antenna 210 can be considered to be divided by the ground plane 204 into two hemispheres. A first hemisphere has the zero of the gain plots as its apex, and a second hemisphere has the 180 degree point of the gain plots as its apex. The emitted power for both modes is greater in the first hemisphere than in the second hemisphere. Improved performance will be realized if the dielectric resonator antenna 210 is oriented so that the first hemisphere faces other antennas in a communication system.

Figure 11:
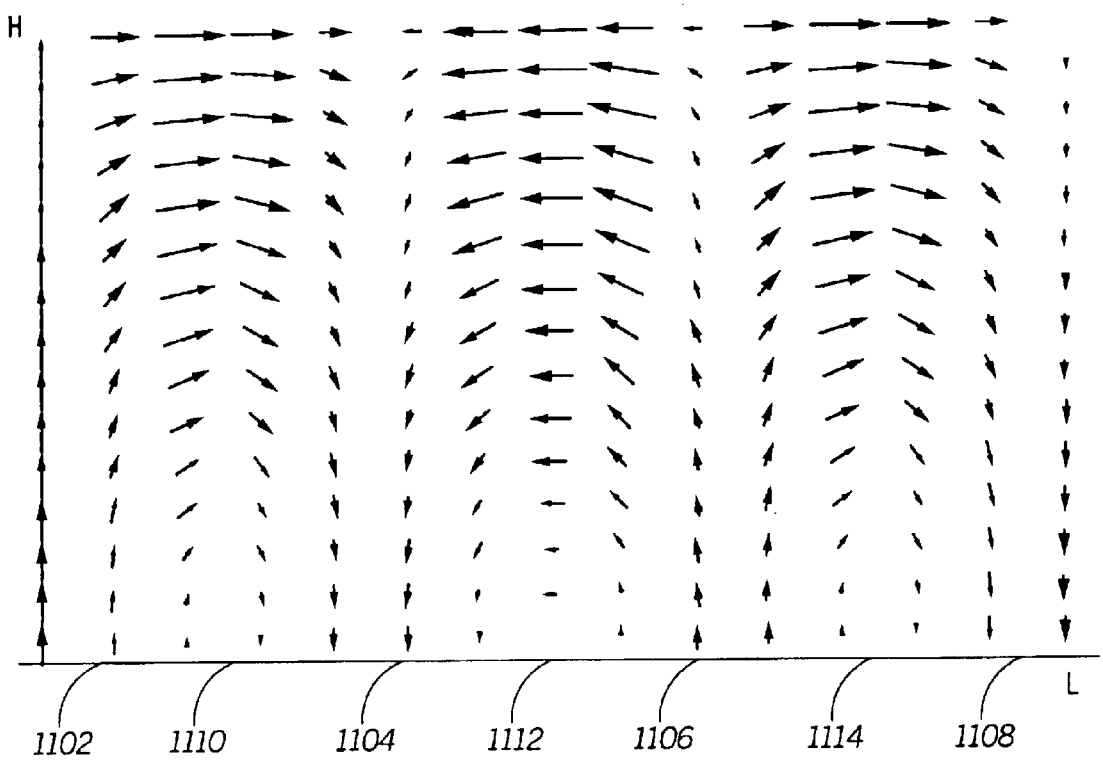
FIG. 11 is an elevation view of the electric field pattern of a third mode of the dielectric resonator antenna shown in FIG. 2 and FIG. 3.

FIG. 11 is an elevation view of the electric field pattern of a third mode of the dielectric resonator antenna 210 shown in FIG. 2 and FIG. 3. The third mode is labeled $TE_{13\delta}$. The second mode index that has a value of three indicates that there are three field nulls including, in order of arrangement, a first 1110, second 1112, and third 1114 null, located along the lower edge 210C (FIG. 3) of the dielectric resonator antenna 210. The first null 1102 is located closest to the first end edge 210E of the dielectric resonator antenna 210. The abscissa and ordinate of FIG. 11 have the same relation to the dielectric resonator antenna 210 as those of FIG. 5. The third mode includes a first 1102, second 1104, third 1106 and fourth 1108 regions along the abscissa of FIG. 11 at which the electric field is relatively strong an oriented perpendicular to the abscissa and microstrip 206.

At the instant shown, the electric field curls from the first high field strength region 1102 around the first null 1110 to the second high field strength region 1104, curls from the third high field strength region 110 around the second null 1112 to the second high field strength region, and from the third high field strength region 1106 around the third null 1114 to the fourth high field strength region 1108.

According to a three resonance embodiment of the invention a dielectric resonator that is capable supporting the first, second, and third modes illustrated in FIGS. 5, 6, and 11 respectively is provided. The statements made elsewhere in this discussion regarding the choice of the dimensions of the dielectric resonator antenna 210, dielectric constants, and the operating wavelength also apply to the three resonance embodiment.

Figure 12:
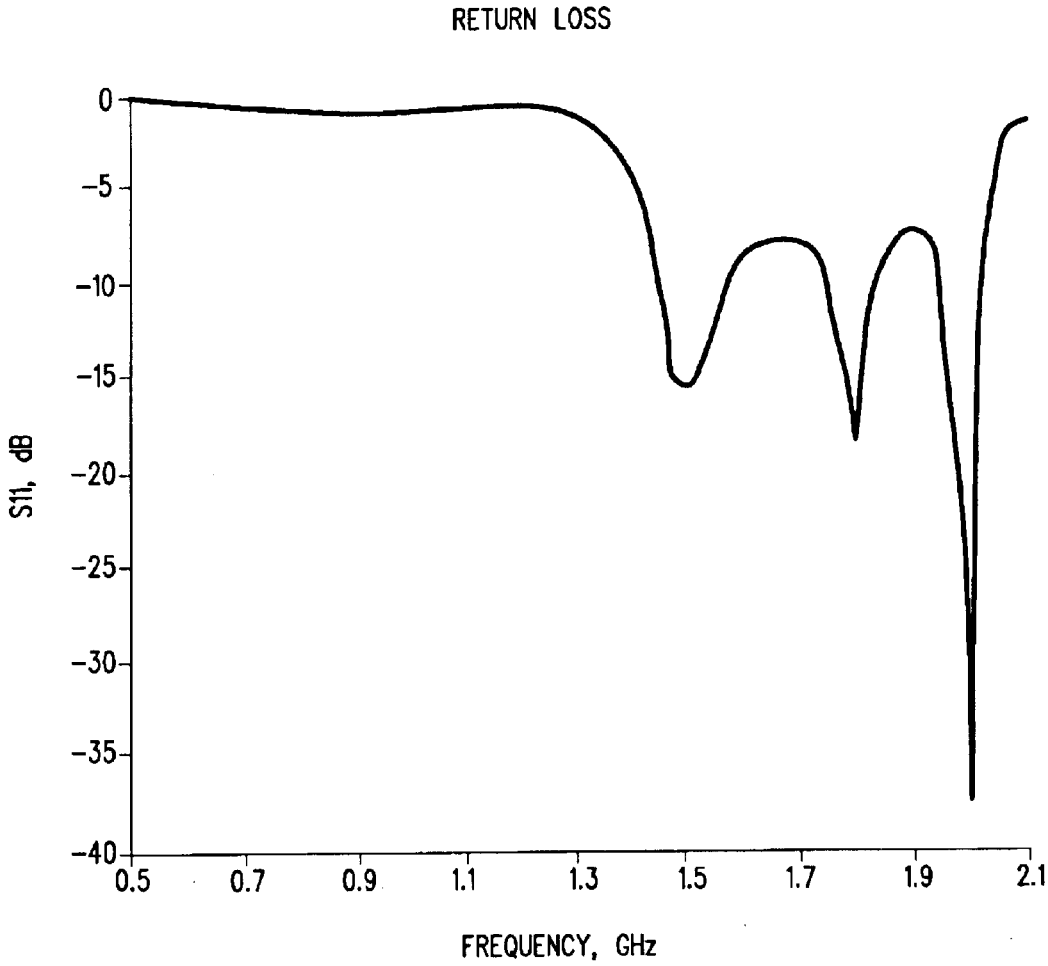
FIG. 12 is graph of return loss versus frequency for a dielectric resonator antenna of the type shown in FIG. 2 and FIG. 3 that supports the third mode shown in FIG. 11.

FIG. 12 is graph 1200 of return loss versus frequency for a dielectric resonator antenna of the type shown in FIG. 2 and FIG. 3 that supports the third mode shown in FIG. 11, in addition to the first and second modes shown in FIGS. 5 and 6 respectively. The dielectric resonator antenna 210 from which the data shown in FIG. 11 was obtained, was made from Magnesium Calcium Titanate, had a length (L) of 54 mm, a height (H) of 14.5 mm, a thickness (T) of 2.8 mm and a dielectric constant of 140. The return loss graph 1200 comprises: a first resonance at 1.5 GHz corresponding to the first mode shown in FIG. 5, a second resonance at 1.8 GHz corresponding to the second mode shown in FIG. 6, and a third resonance at 2.1 Ghz corresponding to the third mode shown in FIG. 11. The three aforementioned resonances combine to form a wide passband that extends from 1.45 GHz to 2.025 GHz.

It may be desirable for certain application to provide an antenna capable of operating at additional frequencies outside of the broad bands of operation of the above described antennas.

Figure 13:
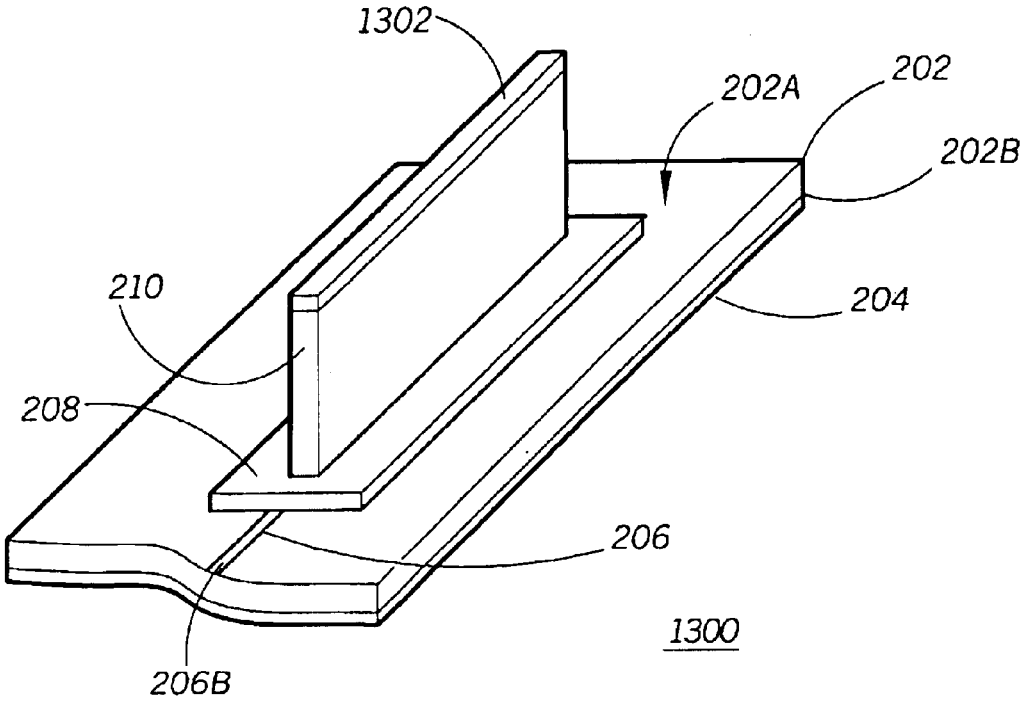
FIG. 13 is a broken out perspective view of a circuit board supporting a dielectric resonator antenna fitted with a parasitic radiator.

FIG. 13 is a broken out perspective view of the circuit board supporting the dielectric resonator antenna 210 fitted with a parasitic radiator. The parts of the antenna system 1300 shown in FIG. 13 that share reference numerals with elements shown in FIG. 2 have been described above with reference to FIG. 2. The antenna system 1300 shown in FIG. 13 includes a parasitic radiator in the form of a first conductive strip 1302 positioned along the upper edge 210D FIG. 3 of the dielectric resonator antenna 210. Notwithstanding the presence of the first conductive strip 1302, the dielectric resonator antenna 210 can sustain at least two modes that are similar to the modes shown in FIGS. 5 and 6. In order that the first conductive strip 210 not interfere with the oscillation in these modes, the height H of the dielectric resonator antenna 210 should be at least one-half of the length L of the dielectric resonator antenna 210. The first conductive strip establishes an additional radiative mode that is characterized by a frequency that is lower than the broad band due to the two modes discussed with reference to FIG. 5 and FIG. 6.

Figure 14:
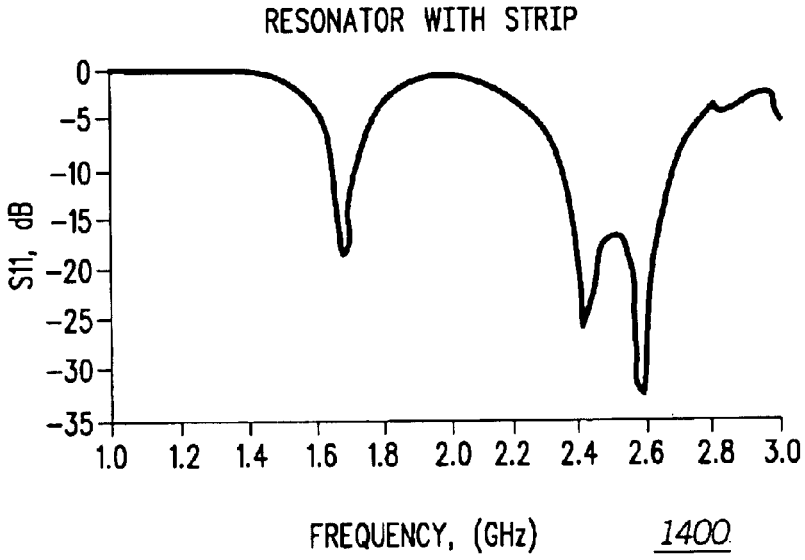
FIG. 14 is a graph of return loss versus frequency for an antenna system of the type shown in FIG. 13.

FIG. 14 is a graph 1400 of return loss versus frequency for an antenna system of the type shown in FIG. 13. The graph 1400 exhibits first and second resonance peaks at about 2.4 Ghz and 2.5 GHz respectively that are part of broadband attributable to resonance modes similar to those shown in FIGS. 5 and 6. The graph 1400 also exhibits another resonance at about 1.7 GHz. The latter is associated with the conductive strip 1302. Thus the conductive strip 1302 provides an addition band in which the antenna system 1300 can be operated in order to support different communication protocols. The dielectric resonator antenna 210 from which the data shown in FIG. 14 was taken had a length (L) of 25 mm, a height (H) of 23 mm, and a thickness (T) of 2 mm, and was made of Neodymium Titanate that had a dielectric constant of 80. The conductive strip 1302 was made of copper and covered the upper edge 210D of the dielectric resonator antenna 210.

Figure 15:
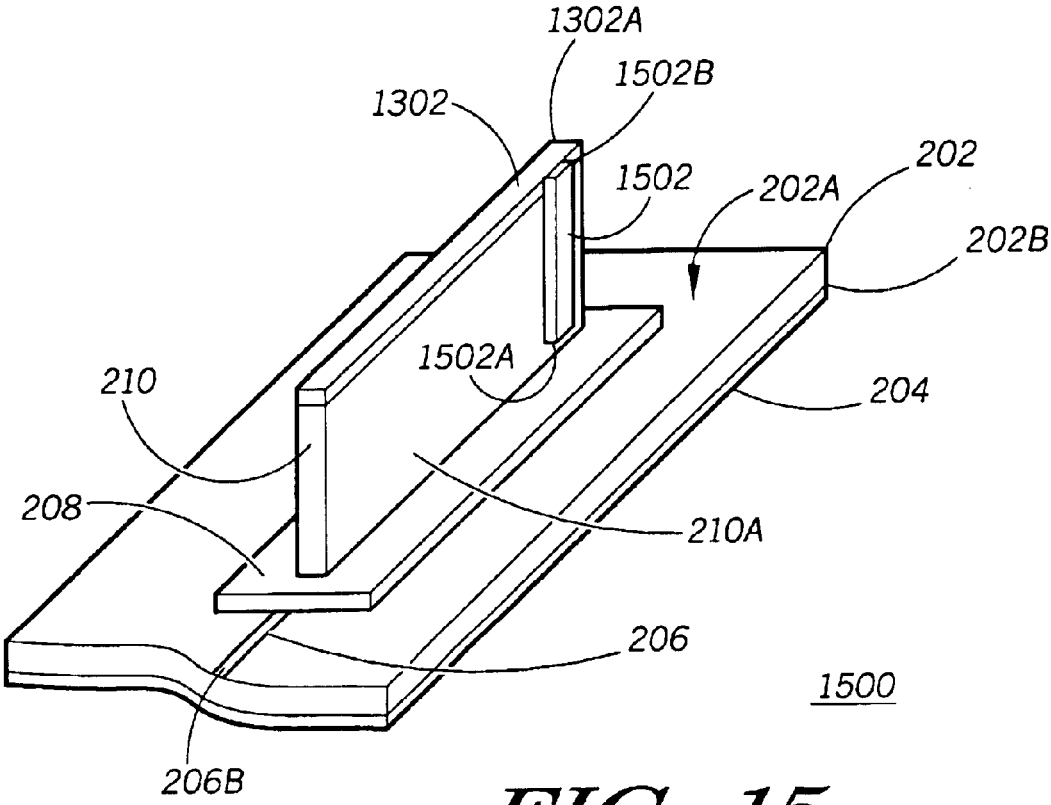
FIG. 15 is broken out perspective view of a circuit board supporting a dielectric resonator antenna including a capacitively loaded parasitic radiator.

FIG. 15 is broken out perspective view of a circuit board supporting a dielectric resonator antenna 210 (FIG. 2) including a capacitively loaded parasitic radiator.

The parts of the antenna system 1500 shown in FIG. 15 that share reference numerals with elements shown in FIGS. 2, 3 and 13 have been described above with reference to those FIGS.

The dielectric resonator antenna 210 used in the antenna system 1500 shown in FIG. 15 includes, in addition to the conductive strip 1302 a second conductive strip 1502 The second conductive strip includes a first end 1502B that is in contact with the first conductive strip 1302. The second conductive strip 1502 extends from a point near an end 1302A of the conductive strip 1302, perpendicularly with respect to substrate 202, along the first large area surface 210A (FIG. 3) towards the microstrip 206. There is a capacitance between a second end 1502A of the second conductive strip 1502 that is remote from the first conductive strip 1302, and the microstrip 206 (FIG. 2) and the ground plane 204 (FIG. 2). The combination of the first 1302 and second 1502 conductive strips is capacitively loaded by the aforementioned capacitance. The capacitive loading lowers the resonant frequency of the combined first and second conductive strips 1302, 1502. The combination of the first and second conductive strips 1302, 1502 exhibits a lower resonance frequency than the first conductive strip alone. This allows communication standards that require more widely separated frequencies to be supported.

Figure 16:
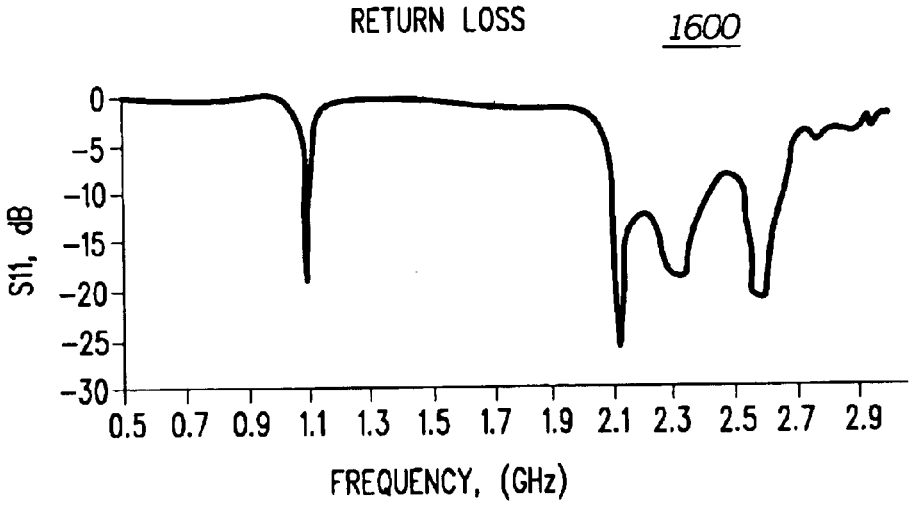
FIG. 16 is a graph of return loss versus frequency for the antennas system shown in FIG. 15.

FIG. 16 is a graph of return loss versus frequency for the antennas system shown in FIG. 15. The additional resonances at about 1.1 GHz and 2.1 GHz are attributed to two harmonics associated with the coupled first 1302 and second 1502 conductive strips. Thus, the antenna system 1500 shown in FIG. 15 includes a broad band of operation that extends from about 2.1 Ghz to about 2.65 GHz, and an additional band of operation at about 1.1 GHz.

Figure 17:
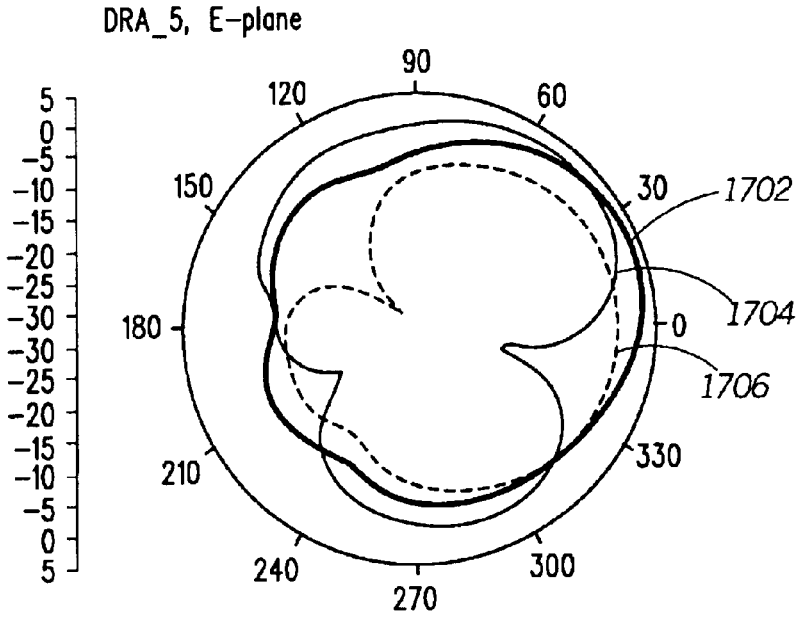
FIG. 17 is a set of E-plane gain plots for an embodiment of the dielectric resonator antenna shown in FIG. 15.
Figure 18:
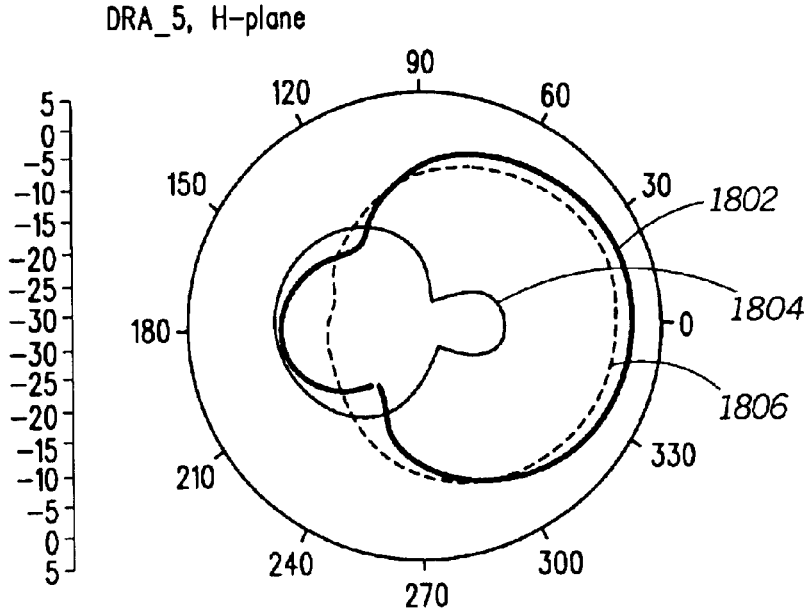
FIG. 18 is a set of H-plane gain plots corresponding to FIG. 17.

FIG. 17 is a set of E-plane gain plots for an embodiment of the dielectric resonator antenna shown in FIG. 15. FIG. 18 is a set of H-plane gain plots corresponding to FIG. 17. Referring to FIGS. 17, 18, the thick solid line E-plane plot 1702 and thick solid H-plane plot 1802 were measured at a frequency of 2.35 Ghz and correspond to the first mode depicted in FIG. 5. The thin solid line E-plane plot 1704 and the thin solid H-plane plot 1804 were measured at a frequency of 2.6 GHz and correspond to the second mode depicted in FIG. 6. The dashed E-plane plot 1706 and the dashed H-plane plot 1806 which were measured at 1.1 GHz correspond to radiated power associated with the first and second conductive strips 1302, 1502. The radiation pattern associated with the first and second conductive strips 1302, 1502 is dipole-like. For all three frequencies, more power is radiated in the hemisphere that has zero at its apex, than in the hemisphere that has 180 degrees at its apex.

Figure 19:
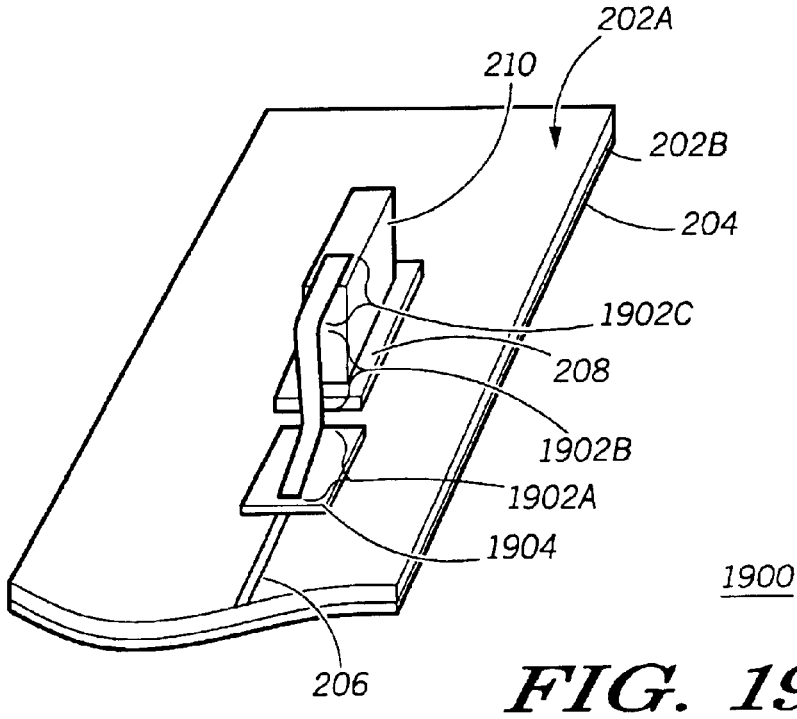
FIG. 19 is a broken out perspective view a first antenna system including a dielectric resonator antenna, and a ribbon.

FIG. 19 is a broken out perspective view a first antenna system 1900 including the dielectric resonator antenna 210, and a ribbon 1902.

Compared to the antenna system 200 depicted in FIG. 2, the antenna system 1900 shown in FIG. 19 includes a conductor in the form of a metal ribbon 1902 that is electromagnetically coupled between the microstrip 206 and the dielectric resonator antenna 210. The electromagnetic coupling between the metal ribbon 1902 and the microstrip 206 is primarily capacitive.

The metal ribbon 1902 includes a first end section 1902A that is parallel to the microstrip 206 and separated from the microstrip 206 by a dielectric material 1904. The dielectric material 1904 preferably takes the form of a slab. The metal ribbon 1902 further comprises a middle section 1902B that is coupled to the first end section 1902A but extends parallel to the height H of the dielectric resonator antenna 210. The metal ribbon 1902 further comprises a second end section 1902C that is connected to the middle section 1902B and extends parallel to the microstrip 206 over the upper edge 210D (FIG. 3) of the dielectric resonator antenna 210.

The first end section 1902A is capacitively coupled through the dielectric material 1904 to the microstrip 206. The second end section 1902C is capacitvely coupled through the dielectric resonator antenna 210, and the spacer layer 208, to the microstrip 206. Because the ribbon 1902 is capacitively loaded at both ends, its effective electrical length is increased, which is to say that its resonant frequency is decreased. By selecting the capacitive loading at one or both of the ends the resonant frequency can be selected. Conveniently, the capacitive loading can be controlled by controlling the length of the first section 1902A, or by controlling the thickness or dielectric constant of the dielectric material 1904.

Electromagnetic signals are coupled between the ribbon 1902 and the microstrip 206. Furthermore electromagnetic signals are also coupled to some extent between the ribbon 1902 and the dielectric resonator antenna 210. The ribbon 1902 adds an additional band of operation to the antenna system 1900. The ribbon 1902 can be used to add an additional band of operation at a frequency that is lower than the frequencies of the modes of the dielectric resonator antenna 210 by itself.

Figure 20:
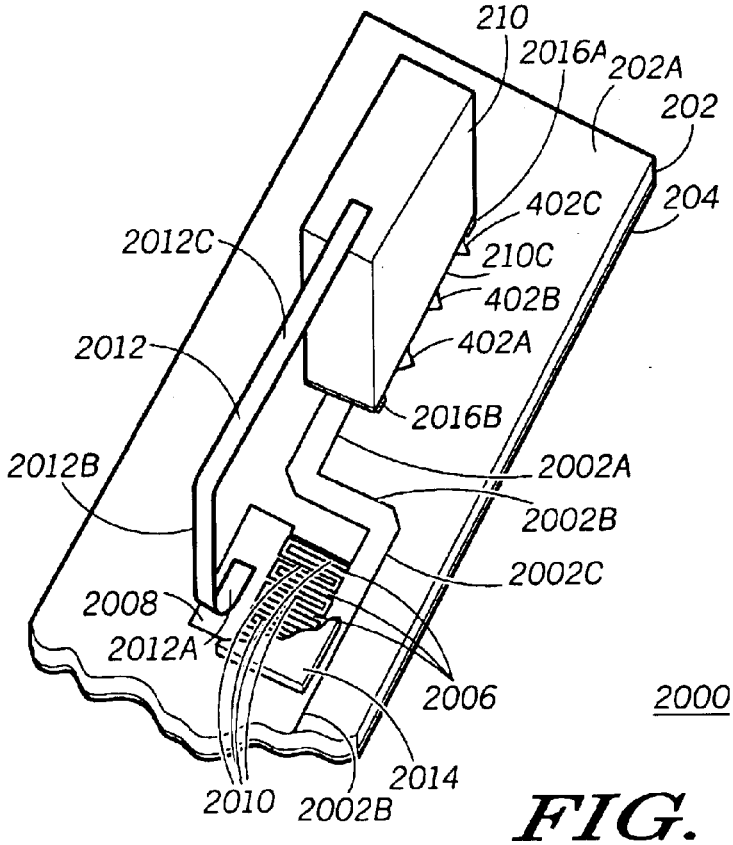
FIG. 20 is a broken out perspective view a second antenna system including a dielectric resonator antenna, and a ribbon.

FIG. 20 is a broken out perspective view a second antenna system including the dielectric resonator antenna 210, and a ribbon 2012. The dielectric resonator antenna 210 is supported above the substrate 202 by first 2016A and second 2016B spacers that are interposed between the lower edge 210C of the dielectric resonator antenna 210, and a first microstrip section 2002A of an antenna feed microstrip 2002. The first 2016A and second 2016B spacers, and air present between them form a low dielectric spacer.

The first microstrip section 2002A is proximate to and parallel to the lower edge 210C of the dielectric resonator antenna 210. A second microstrip section 2002C is longitudinally displaced from, laterally offset from, and parallel to the first microstrip section 2002A and the lower edge 210C of the dielectric resonator antenna 210. An intermediate microstrip section 2002B of the microstrip 2002 runs perpendicular to, and connects the first microstrip section 2002A, and the second microstrip section 2002B. A proximal end 2002B of the microstrip serves as the antenna system input 108A (FIG. 1).

A first plurality of fingers 2006 extend perpendicularly out from the second microstrip section 2002A. A conductive pad 2008 is located to one side of the second microstrip section 2002C in line and displaced longitudinally from the first microstrip section 2002A. A second plurality of fingers 2010 extend from the pad 2008 parallel to the first plurality of fingers 2006 towards the second microstrip section 2002C. The second plurality of fingers 2010 are interleaved (interdigitated) with the first plurality of fingers 2006. There is a capacitance between the first plurality of fingers 2006 and the second plurality of fingers 2010. A dielectric member in the shape of a rectangular dielectric plate 2014 is located over the interdigitated first plurality of fingers 2006, and second plurality of fingers 2010. (In FIG. 20 the rectangular dielectric plate 2014 has been shown broken away, to allow the interdigitated fingers 2006, 2010 to be seen.) The dielectric plate 2014 serves to increase the capacitance between the interdigitated fingers 2006, 2010.

A metal ribbon 2012 includes a first end segment 2012A connected, preferably by soldering to the conductive pad 2008. The metal ribbon 2012 includes an intermediate segment 2012B connected to the first end segment 2012A and to a second end segment 2012C. The intermediate segment 2012B is aligned approximately parallel to the height H dimension of the dielectric resonator antenna 210. The intermediate segment 2012B is spaced from the dielectric resonator antenna 210. The second end segment 2012C extends from the intermediate segment 2012B parallel to the length dimension of the dielectric resonator antenna 210, onto the top edge 210D of the dielectric resonator antenna 210. Both the first end segment 2012A and the second end segment 2012C extend toward the dielectric resonator antenna 210 from the intermediate segment 2002B.

The ribbon 2012 is capacitively coupled to the second microstrip section 2002C through the interdigitated fingers 2006, 2010 at one end, and capacitively coupled to the first microstrip section 2002A through the dielectric resonator antenna 210.

The capacitance between the first end segment 2012A and the second microstrip section 2002C can be controlled by controlling the number, length, and separation between the interdigitated fingers 2006, 2010, or the dielectric constant of the rectangular dielectric plate 2014.

The ribbon 2012 introduces a band of operation for the antenna system 2000 shown in FIG. 20 in addition to the band of operation due to the resonant modes of the dielectric resonator antenna 210 itself (discussed above with reference to FIGS. 5, 6). By increasing the capacitance between the ribbon 2012 and the microstrip 2002 the effective electrical length of the ribbon 2012 can be increased, and its resonant frequency reduced to a low value. It is desirable for certain application (e.g., to support operation at about 900 MHz) to select the capacitance in order to locate the band of operation associated with the ribbon 2012 at a frequency that is lower than the frequencies (See FIG. 7) that characterize the resonant modes (shown in FIGS. 5, 6) of the dielectric resonator antenna 210.

Figure 21:
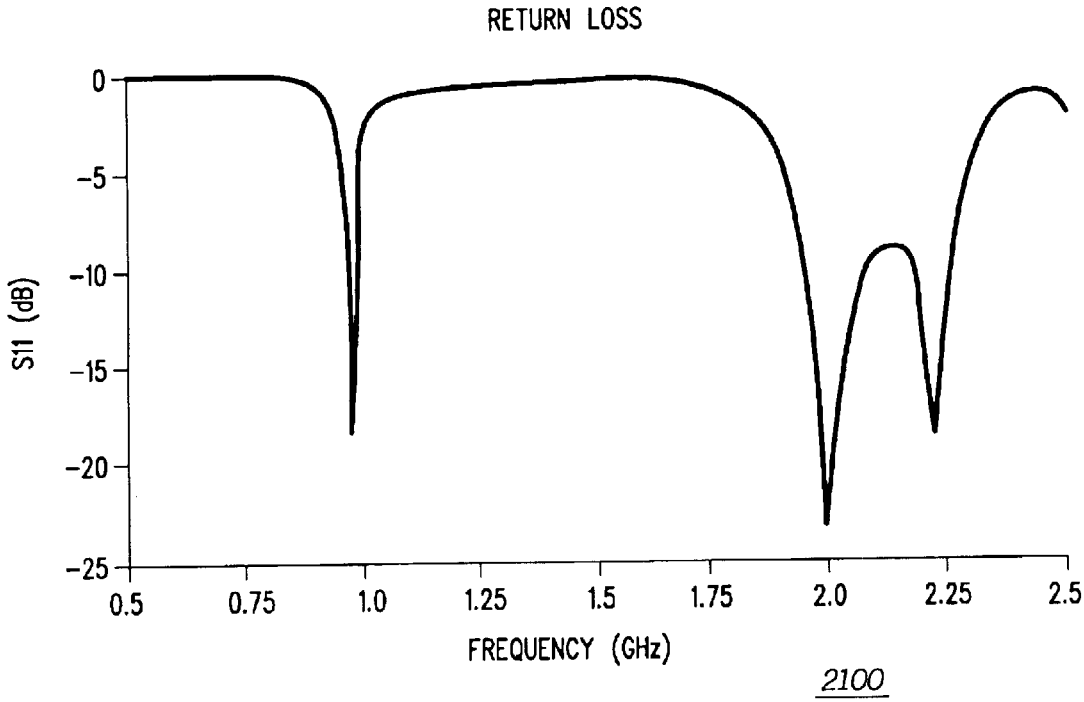
FIG. 21 is a graph of return loss versus frequency for a prototype of the antennas system shown in FIG. 20.

FIG. 21 is a graph 2100 of return loss versus frequency for a prototype of the antennas system shown in FIG. 20. In the prototype used to obtain the measurement data shown in FIG. 21, in order to provide capacitive coupling between the ribbon 2012 and the microstrip 2002 rather than having interdigitated fingers 2006, 2010, the conductive pad 2008 was positioned in close proximity to the second microstrip section 2002C.

The return loss plot 2100 includes a first resonance at about 2 GHz that is attributed to the first mode of the dielectric resonator antenna 210 illustrated in FIG. 5, and a second resonance at 2.2 GHz that is attributed to the second mode of the dielectric resonator antenna 210 that is illustrated in FIG. 6. The return loss plot 2100 further comprises a third resonance at about 940 Mhz that is attributed to radiation from the ribbon 2012.

Figure 22:
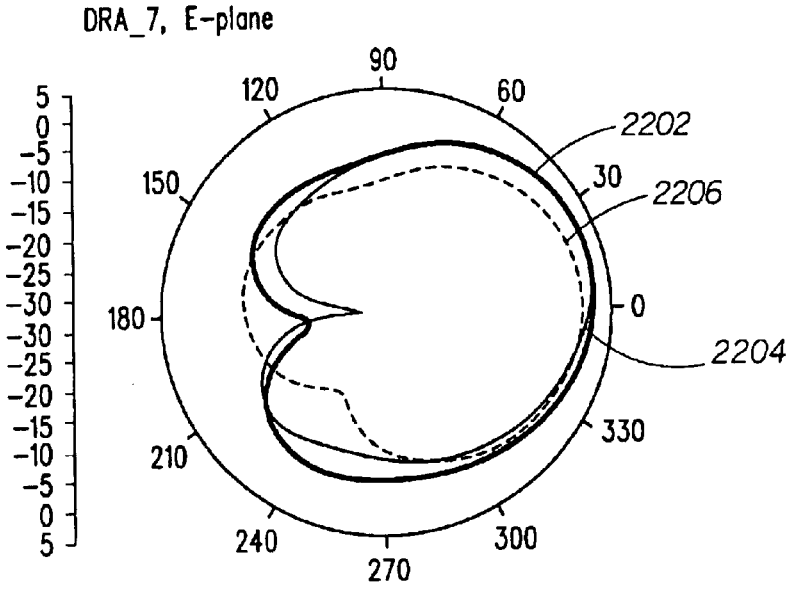
FIG. 22 is a set of E-plane gain plots for the prototype of the antenna shown in FIG. 20.
Figure 23:
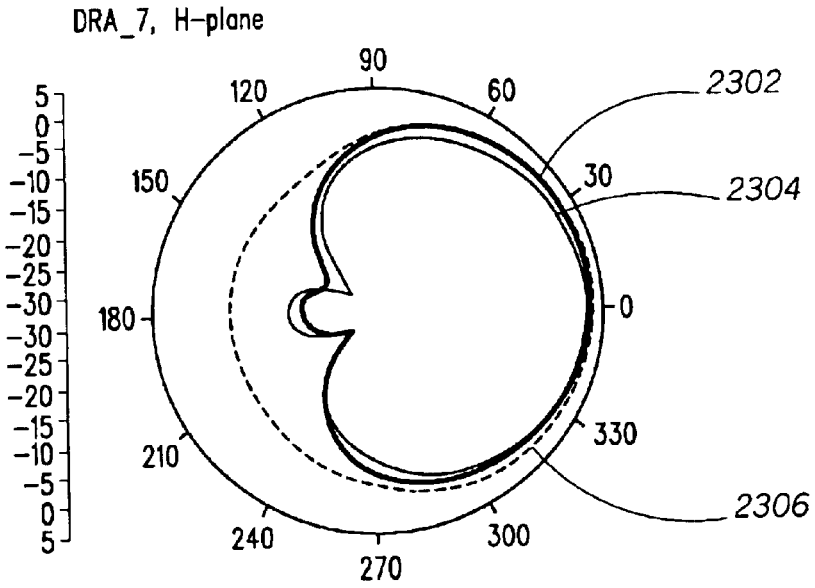
FIG. 23 is a set of H-plane gain plots corresponding to FIG. 22.

FIG. 22 is a set of E-plane gain plots 2200 for the prototype of the antenna shown in FIG. 20. FIG. 23 is a set of H-plane gain plots 2300 corresponding to FIG. 22. A thick solid line E-plane plot 2202 and corresponding thick solid line H-plane plot 2302 were measured at 1.99 GHz and correspond to the first mode of the dielectric resonator antenna 210 shown in FIG. 5. A thin solid line E-plane plot 2204 and corresponding thin solid line H-plane plot 2304 were measured at 2.2 GHz and correspond to the second mode of the dielectric resonator antenna 210 shown in FIG. 6. The dashed E-plane plot 2206 and dashed H-plane plot 2306 which were measured at 937 MHz correspond to radiation attributed to the ribbon 2012. The radiation patterns at all three frequencies include more power in the hemisphere that has zero at its apex than in the hemisphere that has 180 degrees at its apex.

Figure 24:
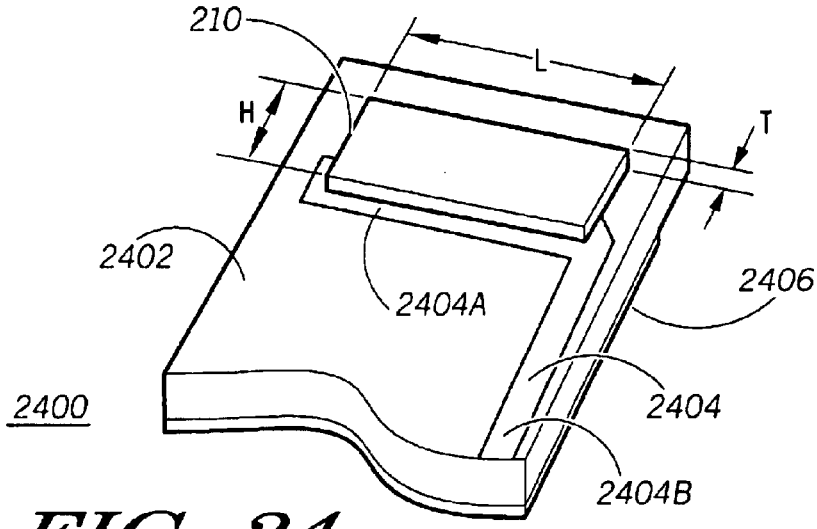
FIG. 24 is a broken out perspective view of a low profile antenna system including a printed circuit board and a thin right parallelepiped dielectric resonator antenna.
Figure 25:
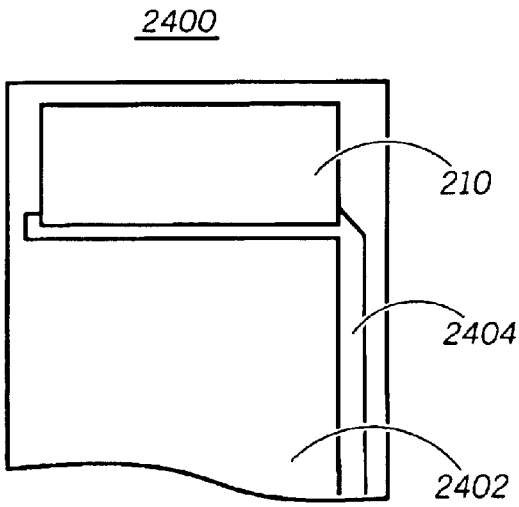
FIG. 25 is a plan view of the obverse side of the antenna system shown in FIG. 24.
Figure 26:
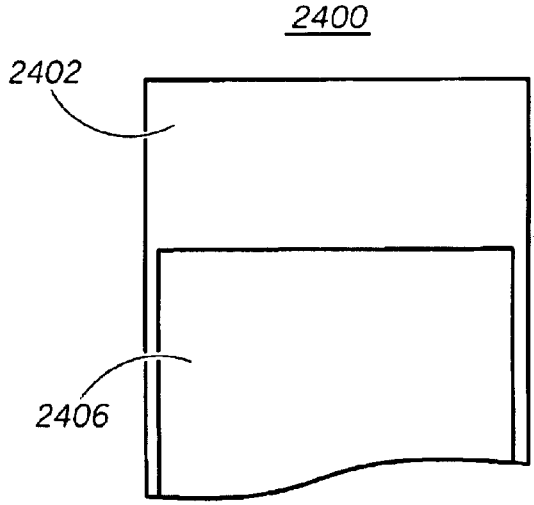
FIG. 26 is a plan view of the reverse side of the antenna system shown in FIG. 24.

FIG. 24 is a broken out perspective view of a low profile antenna system including a circuit substrate and the dielectric resonator antenna 210. FIG. 25 is a plan view of the obverse side of antenna system shown in FIG. 24. FIG. 26 is a plan view of the reverse side of the antenna system shown in FIG. 24.

Referring to FIGS. 24–26, the antenna system 2400 shown therein comprises a circuit substrate substrate 2402, bearing a microstrip 2404 on its obverse side. The microstrip 2404 includes an end segment 2404A that extends under the first large area surface 210A of the dielectric resonator antenna 210, proximate to, and parallel to the lower edge 210C. Note that in this embodiment the dielectric resonator antenna 210 is laid flat on substrate 2402, so that the antenna system 2400 has a low profile. A proximal end 2404B of the microstrip 2404 serves as the antenna input 108A (FIG. 1). A ground plane 2406 covers an area of the reverse side of the substrate 2402. The ground plane 2406 does not cover an area of the reverse side of the substrate underneath the dielectric resonator antenna 210, as doing so would tend to short field lines associated with the desired modes of resonance of the dielectric resonator antenna 210. The area not covered by ground plane is termed a clear area. Thus the ground plane 2406 extends from a direction away from the dielectric resonator antenna 210 up to the location of the lower edge 210C of the dielectric resonator antenna 210, and the end segment 2404A of the microstrip 2404, and not further. The length, height, and thickness dimensions which are indicated as L, H, and T and which were discussed above with reference to FIG. 2 and 3 are indicated on FIG. 25 so that the orientation of the dielectric resonator antenna 210 on the substrate 2402 in the antenna system 2400 shown in FIG. 25 can be understood. The thickness T of the dielectric resonator antenna 210 is oriented perpendicular to the substrate 2402.

The antenna system 2400 shown in FIGS. 22–26 has a low profile that makes it suitable for use within a thin wireless device case. The mounting of the dielectric resonator antenna 210 on the substrate 2402 is also very mechanically stable. The latter quality is especially useful for devices that must meet high shock resistance requirements.

Figure 27:
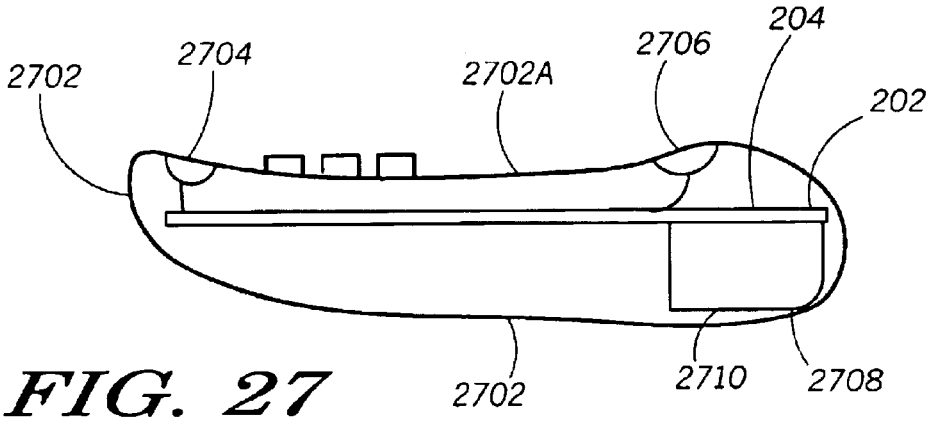
FIG. 27 is a schematic X-ray view of a wireless telephone including a variation of the dielectric resonator antenna shown in FIG. 2.

FIG. 27 is a schematic X-ray view of a wireless telephone 2700 including the dielectric resonator antenna 2810. The dielectric resonator antenna 2710 is different from the dielectric resonator antenna 210 described above, in that it includes a radiused corner 2708. A front side 2702A of the wireless telephone 2700 includes a microphone 2704 and speaker 2706. The dielectric resonator antenna 2710 is mounted on the substrate 202 (FIG. 2), facing a rear side 2702B or the wireless telephone 2700. The ground plane 204 (FIG. 2) is located between the dielectric resonator antenna 2710 and the front side 2702A. The ground plane 204 effects the directional gain of the dielectric resonator antenna 2710 so as to increase the power emitted in one hemisphere, and thereby reduces the battery power require to attain a given emitted signal strength. The radiused corner 2708 allows for a more compact wireless telephone 2700 design.

The invention provides compact antennas for wireless devices that are capable of operating within broad frequency bands, and optionally within additional frequency bands. Certain embodiments of the antennas taught by the present invention are characterized by radiation patterns that have increased directional gain in one hemisphere. These antennas lead to lower transmission power requirements by concentrating emitted power in one hemisphere.

While the preferred and other embodiments of the invention have been illustrated and described, it will be clear that the invention is not so limited. Numerous modifications, changes, variations, substitutions, and equivalents will occur to those of ordinary skill in the art without departing from the spirit and scope of the present invention as defined by the following claims.

What is claimed is:

1. An antenna system comprising:

a dielectric resonator antenna characterized by:

a surface area, A;

a volume, V; and a quantity $A^*\lambda/V$ that is at least about 50, where $\lambda$ is a free space wavelength corresponding to a center frequency of a lowest order mode of the dielectric resonator antenna.

2. The antenna system according to claim 1 wherein:

the quantity $A^*\lambda/V$ is at least about 100.

3. The antenna system according to claim 1 wherein the dielectric resonator antenna has a dielectric constant of at least about 25.

4. The antenna system according to claim 3 wherein the dielectric resonator antenna has a dielectric constant of at least about 40.

5. The antenna system according to claim 4 wherein:

the dielectric resonator antenna is made from material selected from the group consisting of: Neodymium Titanate and Magnesium Calcium Titanate.

6. The antenna system according to claim 1 wherein:

The dielectric resonator antenna includes:

a first large area surface;

a second large area surface; and is further characterized by:

a thickness T measured between the first large area surface and the second large area surface;

a height, H; and a length, L.

7. The antenna system according to claim 6 wherein:

a ratio of the length of the dielectric resonator antenna to the thickness of the dielectric resonator antenna is at least about 10.

8. The antenna system according to claim 7 wherein:

the height of the dielectric resonator antenna is between about ¼ and one times the length of the dielectric resonator antenna.

9. The antenna system according to claim 8 wherein:

the dielectric resonator antenna is right parallelepiped in shape.

10. The antenna system according to claim 1 further comprising:

a first edge extending between the first large area surface and the second large area surface; and a microstrip arranged parallel to and adjacent to the first edge.

11. The antenna system according to claim 10 further comprising:

a spacer layer located between the microstrip and the first edge of the dielectric resonator antenna.

12. The antenna system according to claim 11 wherein:

the spacer layer comprises a material selected from the group consisting of polytetrafluoroethylene, air, and paper.

13. The antenna system according to claim 11 wherein:

the spacer layer has a thickness of between about 50 and 500 microns, and a dielectric constant of less than about 4.

14. The antenna system according to claim 1 further comprising:

a conductive shield that has a width measured parallel to the thickness of the dielectric resonator antenna that is equal to at least about 0.95 times the height of the dielectric resonator antenna.

15. The antenna system according to claim 14 wherein:

the width of the conductive shield is less than about 3.5 times the height of the dielectric resonator antenna.

16. The antenna system according to claim 14 wherein:

the conductive shield comprises a microstrip ground plane.

17. An antenna system comprising:

a dielectric resonator antenna including:

a first large area surface;

a second large area surface opposite to the first large area surface; and a first edge that extends between the first large area surface and the second large area surface;

a parasitic element positioned along the first edge; and a signal feed for coupling signals to and from the dielectric resonator antenna.

18. The antenna system according to claim 17 wherein the parasitic element is capacitively loaded.

19. The antenna system according to claim 18 wherein:

the parasitic element comprises a first metal strip including a first end.

20. The antenna system according to 19 wherein:

the dielectric resonator antenna further comprises:

a second edge that extends between the first large area surface and the second large area surface; and the signal feed comprises:

a microstrip that is arranged parallel to and adjacent to the second edge.

21. The antenna system according to claim 20 further comprising:

a capacitive coupling element that capacitively couples the first metal strip and the microstrip.

22. The antenna system according to claim 21 wherein:

the capacitive coupling element comprises:

a second metal strip that extends from the first metal strip over the first large area surface toward the microstrip.

23. The antenna system according to claim 20 wherein:

the first edge is opposite to the second edge.

24. The antenna system according to claim 23 wherein:

the dielectric resonator antenna is a parallelepiped characterized by:

a height measured between the first edge, and the second edge;

a resonator length corresponding to a length of the first edge; and a thickness measured between the first large area surface and the second large area surface; and a ratio of the height to the resonator length is more than about 0.5.

25. The antenna system according to claim 24 wherein:

the dielectric resonator antenna has a dielectric constant of at least about twenty-five.

26. The antenna system according to claim 25 further comprising:

a spacer layer that has a dielectric constant that is less than about 4 located between the dielectric resonator antenna and the microstrip.

27. The antenna system according to claim 26 wherein:

the spacer layer has a thickness of between 50 and 500 microns.

28. A antenna system comprising:

a dielectric resonator antenna;

a transmission line electromagnetically coupled to the dielectric resonator antenna;

a conductor including:

a first end positioned proximate the dielectric resonator antenna; and a second end; and an electromagnetic coupling for coupling the second end to the transmission line.

29. The antenna system according to claim 28 wherein the dielectric resonator antenna comprises:

a first large area surface;

a second large area surface opposite to the first large area surface; and a first edge that extends between the first large area surface and the second large area surface; and the dielectric resonator antenna is characterized by a height dimension measured along the first large area surface in a direction perpendicular to the first edge.

30. The antenna system according to claim 29 wherein the transmission line comprises:

a microstrip that is positioned adjacent to and parallel to the first edge.

31. The antenna system according to 29 wherein the electromagnetic coupling comprises a capacitive coupling.

32. The antenna system according to claim 31 wherein:

the capacitive coupling comprises an insulator interposed between the microstrip and the conductor.

33. The antenna system according to claim 31 wherein the conductor comprises:

a metal ribbon including:

a middle section that is aligned parallel to the height of the dielectric resonator antenna and is spaced from the dielectric resonator antenna;

a first end section that is capacitively coupled to and aligned parallel to the microstrip; and a second end section that is parallel to the first end section and at least partially overlies the dielectric resonator antenna.

34. The antenna system according to claim 31 wherein:

the microstrip comprises:

a first section that is approximately adjacent to and parallel to the edge of the dielectric resonator antenna;

a second section that is offset from the first section; and an intermediate section between the first section and the second section; and the capacitive coupling comprises:

a first plurality of fingers extending from the first section; and a pad that is located at a side of the second section, in line with the first section, is coupled to the conductor, and includes a second plurality of fingers that are interdigitated with the first plurality of fingers.

35. The antenna system according to claim 34 wherein:

the capacitive coupling further comprises:

a dielectric material overlying the interdigitated first plurality of fingers and second plurality of fingers.

36. An antenna system comprising:

a ground plane;

a circuit substrate including an obverse side and a reverse side that includes a first area covered by the ground plane and a second area that is not covered by the ground plane;

a dielectric resonator antenna supported on the obverse side, over the clear area, the dielectric resonator antenna including an edge, the dielectric resonator antenna being characterized by: a surface area A, a volume V, a quanity $A^*\lambda/V$ that is at least about 50, where $\lambda$ is a free space wavelenght associated with a lowest order mode of the dielectric resonator antenna; and a microstrip on the obverse side, the microstrip including an end segment parallel to and proximate to the edge.

* * * * *